US005353755A

United States Patent [19]

Matsuo et al.

[11] Patent Number: 5,353,755

[45] Date of Patent: Oct. 11, 1994

[54] ARRANGEMENT OF VARIABLE VALVE TIMING CONTROL SYSTEM ON V-TYPE ENGINE

[75] Inventors: Isaya Matsuo, Yokohama; Kaoru Haga, Kawasaki, both of Japan

[73] Assignee: Nissan Motor Co., Ltd., Yokohama, Japan

[21] Appl. No.: 183,439

[22] Filed: Jan. 18, 1994

[30] Foreign Application Priority Data

Jan. 18, 1993 [JP] Japan ..... 5-006085

[51] Int. Cl.[5] ..... F01L 1/02

[52] U.S. Cl. ..... 123/90.13; 123/90.17; 123/90.31; 123/90.38; 123/196 M

[58] Field of Search ..... 123/90.12, 90.13, 90.15, 123/90.16, 90.17, 90.31, 90.33, 90.38, 55 VF, 55 VS, 55 VE, 55 V, 196 M, 195 C, 198 E

[56] References Cited

U.S. PATENT DOCUMENTS 4,607,601 8/1986 Kohler ..... 123/90.31
4,883,027 11/1989 Oikawa et al. .
4,928,641 5/1990 Niizato et al. .
5,010,859 4/1991 Ogami et al. ..... 123/195 C
5,195,472 3/1993 Jacques et al. .
5,216,984 6/1993 Shimano .
5,271,360 12/1993 Kano et al. .

FOREIGN PATENT DOCUMENTS 212981 3/1987 European Pat. Off. ..... 123/90.33

*Primary Examiner*—E. Rollins Cross
*Assistant Examiner*—Weilun Lo
*Attorney, Agent, or Firm*—Foley & Lardner

[57] ABSTRACT

A V-type internal combustion engine comprises a plurality of hydraulically actuable valve operation mode control actuators for two cylinder banks. A hydraulic fluid network is fluidly disposed between a main gallery of the cylinder block and the plurality of hydraulically actuable valve operation mode control actuators and includes a single control valve. The single control valve is common to all of the plurality of hydraulically actuable valve operation mode control actuators. This control valve is attached to a casing adapted to receive a drive system connecting the engine camshafts to the engine crankshaft. This casing has internal passages forming a part of the hydraulic fluid network between the control valve and the plurality of hydraulically actuable valve operation mode control actuators.

23 Claims, 17 Drawing Sheets

ARRANGEMENT OF VARIABLE VALVE TIMING CONTROL SYSTEM ON V-TYPE ENGINE

BACKGROUND OF THE INVENTION

The present invention relates to a variable valve timing control system for a V-type internal combustion engine, namely, an engine of the type including first and second cylinder banks arranged to form the letter V (capital vee).

V-type internal combustion engines are well known. Among them, a known V-type internal combustion engine includes first and second cylinder banks, each including three cylinders, in which for activating intake and exhaust valves, two intake camshafts and two exhaust camshafts are arranged on the two cylinder banks. In other words, two camshafts, namely, an inatake camshaft and an exhaust camshaft, are arranged on each of the two banks.

There is a demand for installation of a variable valve timing control system on a V-type internal combustion engine of the above kind. Besides, there is a demand for transverse mount of the V-type internal combustion in an engine compartment of an automotive vehicle. Particularly, for the transverse engine mount, there is little room left in the engine room in front of a casing for a power transmission member, i.e., a chain or a belt, interconnecting the engine crankshaft and the four camshafts.

SUMMARY OF THE INVENTION

An object of the present invention is to improve a variable valve timing control system and an engine of the type including two cylinder banks arranged to form the letter V (capital vee) such that the number of component parts of the variable valve timing control device is minimized and the component parts are arranged without any increase in an longitudinal direction of the V-type engine.

According to the present invention, there is provided a V-type internal combustion engine, comprising:

first and second cylinder banks arranged to form the letter V (capital vee);

a plurality of camshafts including two camshafts for said first and second cylinder banks, respectively;

a casing adapted to receive a drive system connecting said four camshafts to a crankshaft of the engine for turning said camshafts by rotation of the crankshaft;

a plurality of hydraulically actuable valve operation mode control actuators for said first and second cylinder banks;

a source of pressurized hydraulic fluid;

a hydraulic fluid network fluidly disposed between said source of pressurized hydraulic fluid and said plurality of hydraulically actuable valve operation mode control actuators;

said hydraulic fluid network including a control valve fluidly disposed between said source of pressurized hydraulic fluid and said plurality of hydraulically actuable valve operation mode control actuators;

said control valve being attached to said casing and disposed between said first and second cylinder banks; and said casing having internal passage means forming a part of said hydraulic fluid network between said control valve and said plurality of hydraulically actuable valve operation mode control actuators.

DETAILED DESCRIPTION OF THE INVENTION

Figure 1:
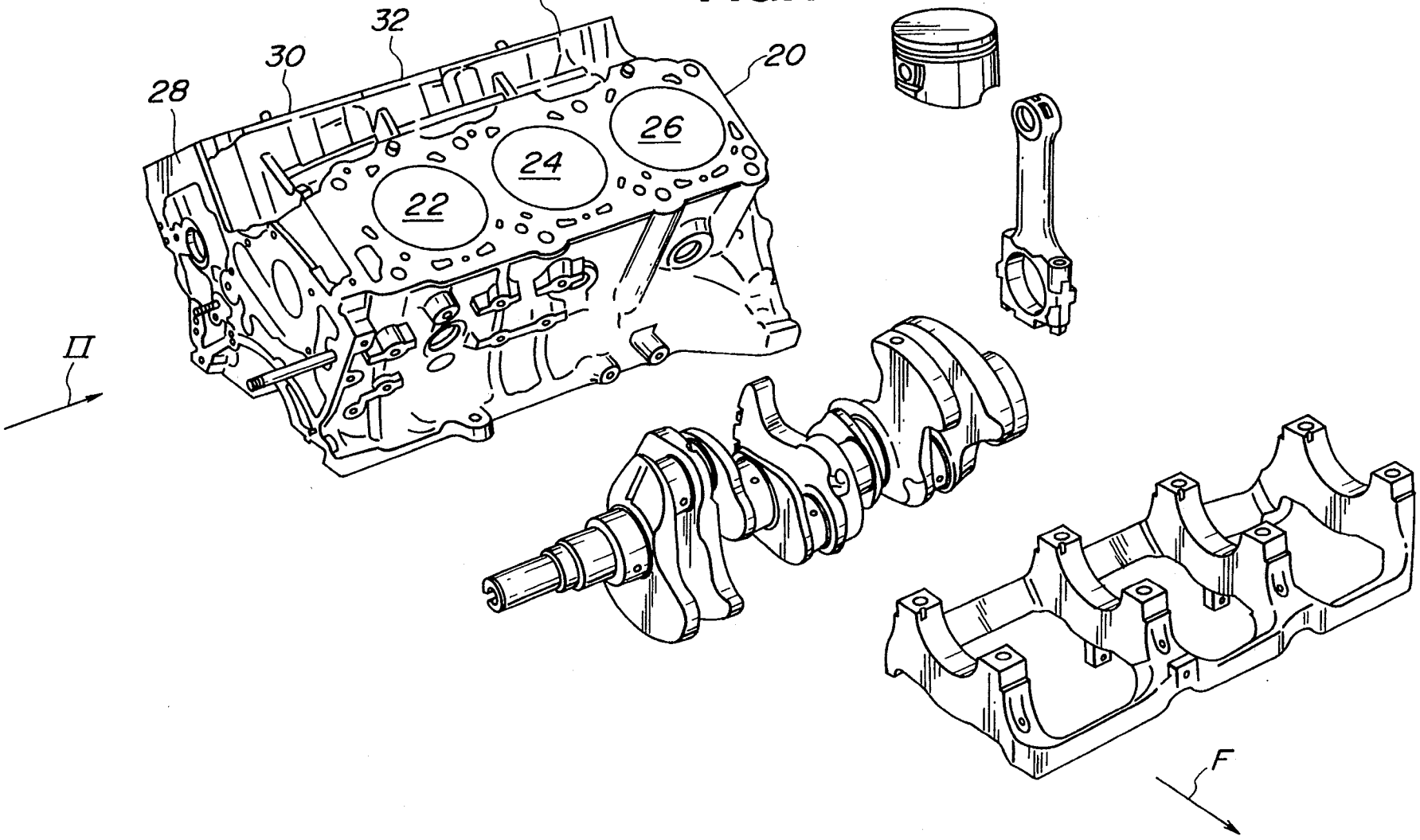
FIG. 1 is a perspetive diagram showing component parts of an engine main body of a V-type internal combustion engine.

Referring to the accompanying drawings, like reference numerals are used to denote like or similar portions or parts. Three embodiments are described, namely a first embodiment described in connection with FIGS. 1 to 8, a second embodiment described in connection mainly with FIGS. 9 to 15, and a third embodiment described in connection mainly with FIGS. 16 to 18.

Figure 2:
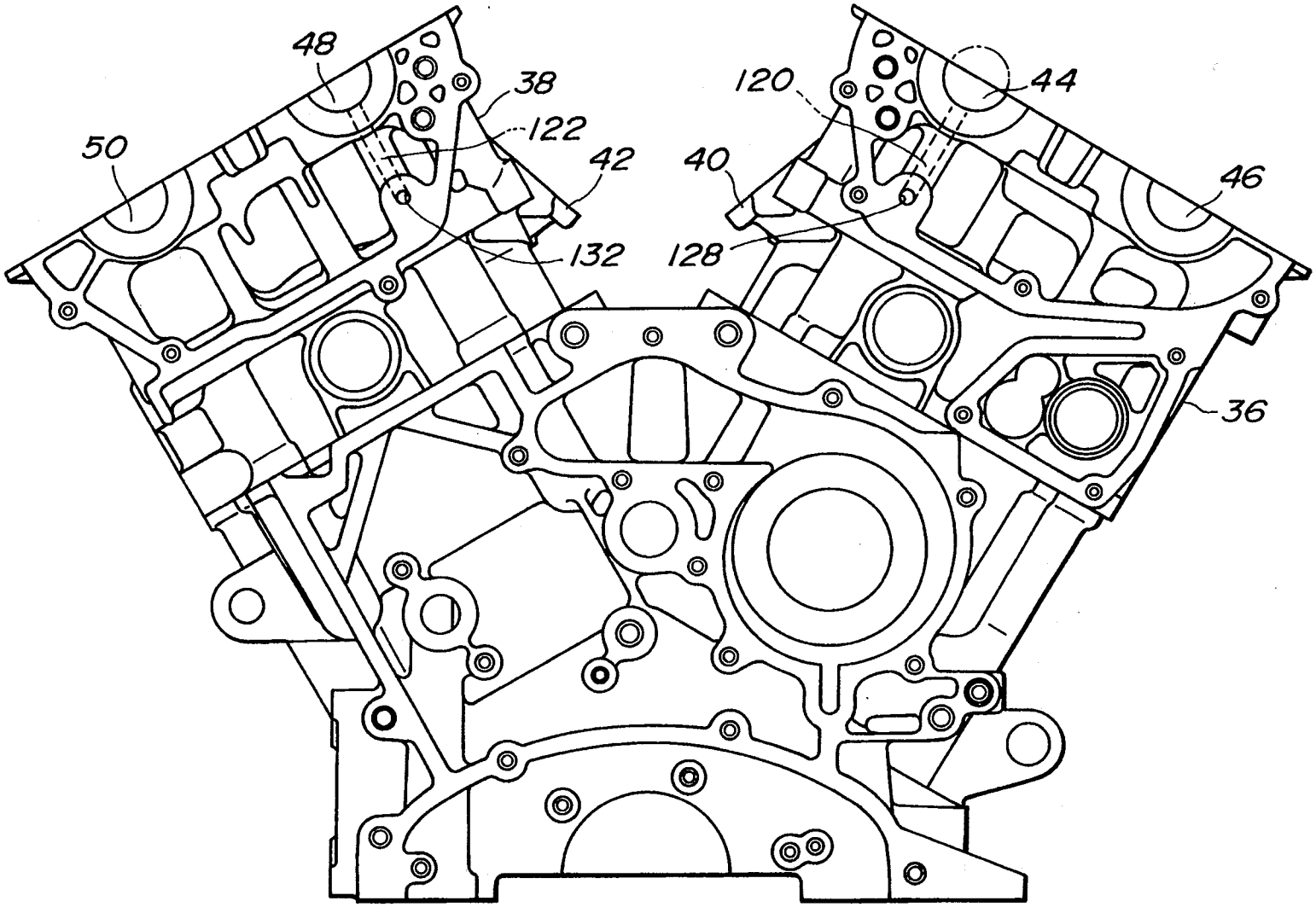
FIG. 2 is a diagram showing the cylinder block with cylinder heads as viewed along an arrow II in FIG. 1.

Before entering into detailed description of each of the embodiments, a general construction of a so-called V-type internal combustion engine is briefly explained. As shown in FIG. 1, the engine main body includes a cylinder block 10, a plurality of pistons, only one being shown at 16, and a plurality of connecting rods, only one being shown at 18. The cylinder block 10 includes a first cylinder bank 20 formed with three cylinders, namely, a No. 2 cylinder 22, a No. 4 cylinder 24, and a. No. 6 cylinder 26, and a second cylinder bank 28 formed with three cylinders, namely a No. 1 cylinder 30, a No. 3 cylinder 32, and a No. 5 cylinder 34. As best seen in FIG. 2, the first and second cylinder banks 20 and 28 are arranged to form the letter V (capital vee). The so-called V-type internal combustion engine is derived from this arrangement of the cylinder banks 20 and 28. Also shown in FIG. 2 are a first cylinder head 36 fixedly bolted to and forming a part of the first cylinder bank 20 and a second cylinder head 38 fixedly bolted to and forming a part of the second cylinder bank 28. The first and second cylinder heads 36 and 38 have intake ports 40 and 42. The first and second intake ports 40 and 42 face a space above the cylinder block 10 between the first and second cylinder heads 36 and 38. The first cylinder head 36 has an upper end designed to rotatably support one intake camshaft at 44 and one exhaust camshaft at 46, while the second cylinder head 38 has an upper end designed to rotatably support one intake camshaft at 48 and one exhaust camshaft at 50.

Referring also to FIGS. 3 to 8, the first embodiment is described.

Figure 3:
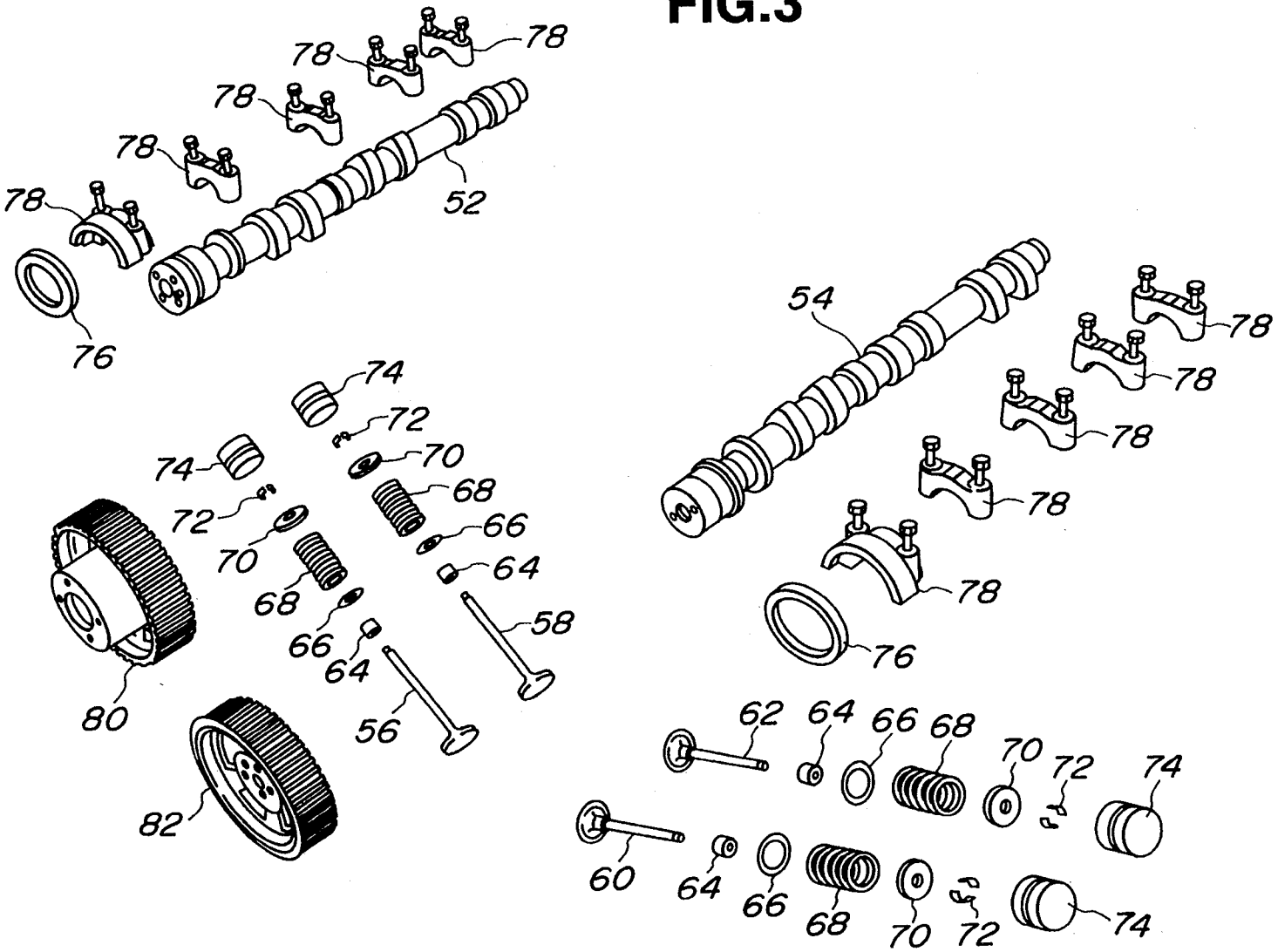
FIG. 3 is a diagram showing components parts of a valve drive mechanism of the V-type internal. combustion engine.

As will now be understood from the preceding description, two intake camshafts, one being shown at 52 in FIG. 3, are arranged for the first and second cylinder banks 20 and 28, respectively, and two exhaust camshafts, one being shown at 54 in FIG. 3, are arranged for the first and second cylinder banks 20 and 28, respectively, resulting in four camshafts. Per each cylinder, two intake valves and two exhaust valves are arranged and driven by the corresponding intake and exhaust camshafts.

The two intake valves 56 and 58 and two exhaust valves 60 and 62 for one cylinder are illustrated in FIG. 3. Each of such valves is shown with its cooperating parts, namely, a valve oil seal 64, a valve spring seat 66, a valve spring 68, a collet 72, and a hydraulic valve lifter 74. In FIG. 3, each of the intake and exhaust camshafts 52 and 54 is shown with its cooperating parts, namely, an oil seal 76 and five cam brackets 78. With the cam brackets 78, the intake and exhaust camshafts 52 and 54 are rotatably held on the corresponding cylinder head 36 or 38.

All of the four camshafts are driven by the engine crankshaft 12 by a conventional drive system using a crankshaft pulley, not shown, coupled with the engine crankshaft 12, four cam pulleys, only two being shown at 80 and 82 in FIG. 3, coupled with the four camshafts, respectively, and two idler pulleys for the first and second cylinder heads 36 and 38, respectively, and power transmission members like timing chains, not shown. The conventional drive system connects the four camshafts to the engine crankshaft for turning them by rotation of the crankshaft. The drive system of this kind is disclosed in U.S. Pat. No. 5,010,859 issued on Apr. 30, 1991 to Ogami et al., the disclosure of which has been incorporated in its entirety herein by reference. The drive system is received in a casing 84 (see FIG. 4) with a cover 86 (see FIG. 5) in a conventional manner.

According to this embodiment, among the four cam pulleys, two exhaust cam pulleys, one being shown at 82 in FIG. 3, are of the conventional type having a cam sprocket fixedly coupled with the corresponding one exhaust camshaft, while, two intake cam pulleys, only one being shown at 80 in FIG. 3, are of a hydraulically actuable valve operation mode control actuator. The detail of this hydraulically actuable valve operation mode control actuator is explained later in connection with FIGS. 7 and 8.

According to this embodiment, each of the hydraulically actuable valve operation mode control actuators is able to vary an angular displacement of the corresponding one of the intake camshafts. There is a hydraulic fluid network fluidly disposed between a source of pressurized hydraulic fluid in the form of a main gallery 88 (see FIG. 5) and the two hydraulically actuable valve operation mode control actuators, only one being shown at 80 in FIG. 3, for the first and second cylinder banks 20 and 28, respectively. The cylinder block 10 is formed with the main gallery 88.

The hydraulic fluid network includes a control valve 90 which is explained later in connection with FIGS. 7 and 8. The control valve 90 is fluidly disposed between the main gallery 88 (see FIG. 5) and the two hydraulically actuable valve operation mode control actuators.

Figure 4:
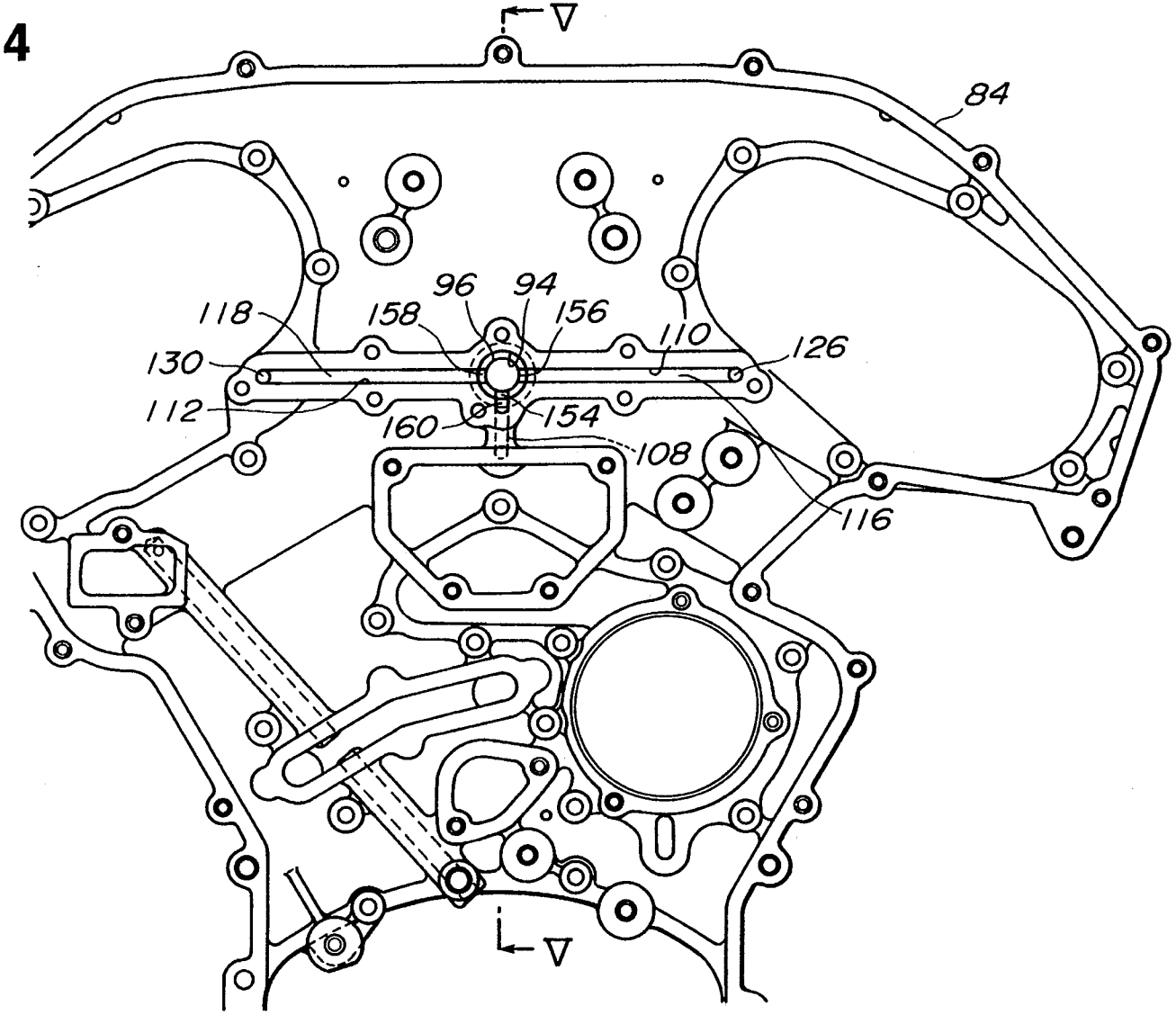
FIG. 4 is a diagram showing a fragmentary front elevation of a casing adapted to receive a camshaft drive system using a power transmission member such as a timing chain or belt.
Figure 5:
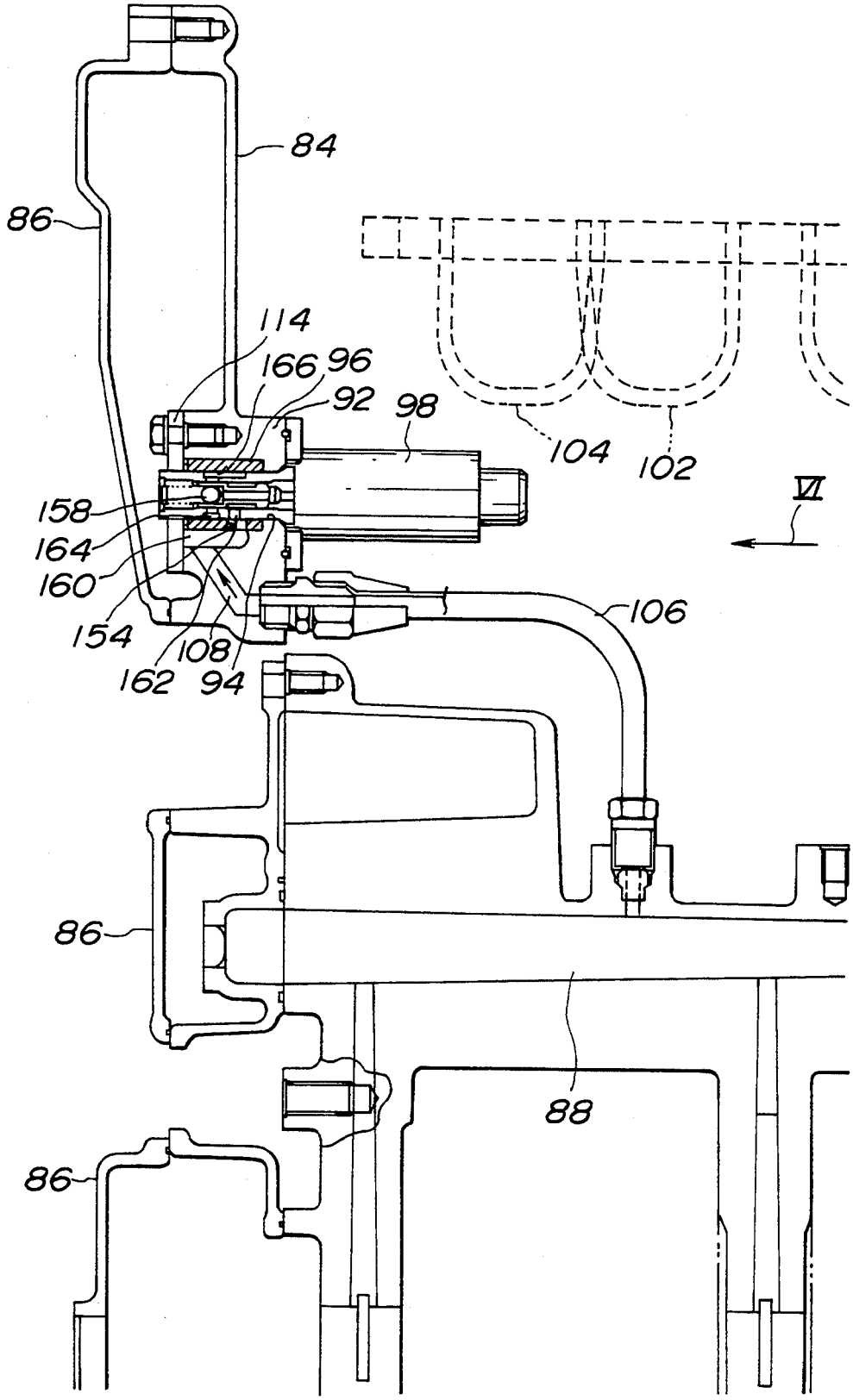
FIG. 5 is a diagram showing a section taken through the line V—V of FIG. 4.
Figure 6:
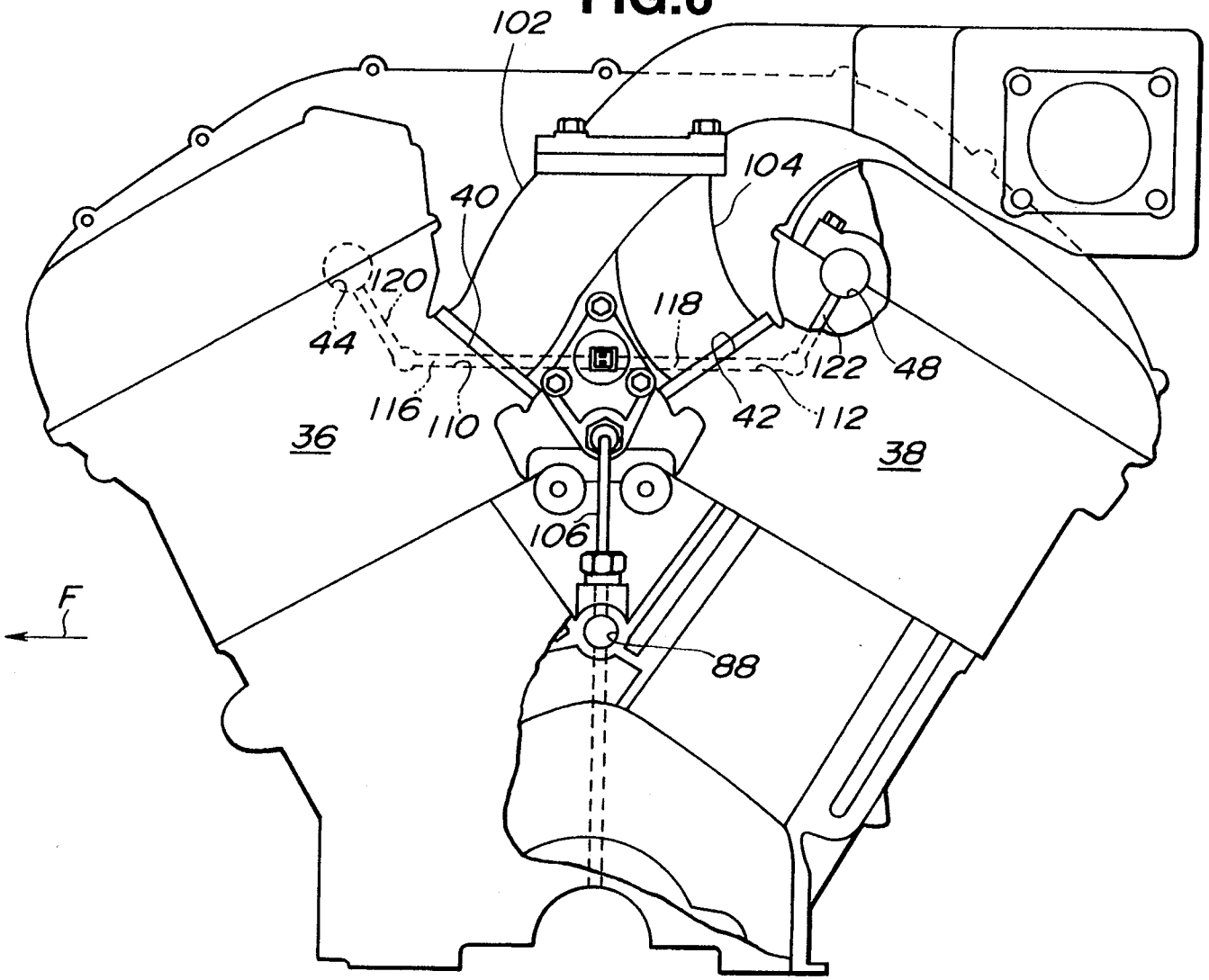
FIG. 6 is a diagram showing FIG. 5 the casing as viewed in the direction of an arrow VI in FIG. 5.

As best seen in FIGS. 5 and 6, the control valve 90 is attached to the casing 84 and disposed between the first and second cylinder banks 20 and 28. Specifically, the casing 84 has an integral boss 92 formed with a stepped bore 94 receiving therein the control valve 90 via a bushing 96. As is seen from FIGS. 4 and 6, the integral boss 92 is situated equi-distant from the first and second cylinder heads 36 and 38.

Referring to FIGS. 5 and 6, the control valve 90 includes a solenoid actuator 98 which is disposed in a space between the cylinder heads 36 and 38 above the cylinder block 10. Specifically, the solenoid actuator 98 is disposed between the cylinder banks 20 and 28 and equi-distant therefrom. The space between the cylinder banks 20 and 28 is subject to radiation of heat from the wall of the cylinder banks 20 and 28 during operation of the engine. In order to cool air around the control valve 90, cool intake air passing through an intake manifold 100 is utilized. The intake manifold 100 has branch pipes, only two being shown at 102 and 104 (see FIG. 6), are connected to the cylinder heads 36 and 38 at the intake ports 40 and 42. As best seen in FIG. 6, the branch pipes 102 and 104 extend through an area adjacent the solenoid actuator 98 of the control valve 90. This arrangement is effective in cooling air around the control valve 90.

In order to supply hydraulic fluid, i.e., oil, to the control valve 90, the hydraulic fluid network includes an external pipe 106 and an inclined passage 108 of the integral boss 92 as shown in FIG. 5. The pipe 106 interconnects the cylinder block 10 and the integral boss 92 and has one end communicating with the main gallery 88 and an opposite end communicating with the inclined passage 108.

Fluid connection between the control valve 90 and sites 44 and 48 rotatably supporting the intake camshafts is explained. As best seen in FIG. 4, the casing 84 is formed with two grooves 110 and 112 extending in the opposite directions from the bore 94 of the boss 92 towards the cylinder heads 36 and 38 (see FIG. 6). These opposite grooves 110 and 112 are covered by a cover 114 (see FIG. 5) to form internal passages 116 and 118, respectively. As shown in FIG. 6, the internal passages 116 and 118 of the casing 84 communicate with internal passages 120 and 122 of the cylinder heads 36 and 38 (see FIG. 2), respectively. Connection between the internal passage 116 of the casing 84 and the internal passage 120 of the cylinder head 36 is accomplished by aligning a port 126 with a bore 128 (see FIG. 2), while connection between the internal passage 118 and the internal passage 122 is accomplished by aligning a port 130 with a bore 132 (see FIG. 2).

Referring to FIG. 5, the control valve 90 includes a valve sleeve 140 and a valve spool 142. The solenoid actuator 98 has a plunger 144 inserted into the valve sleeve 140 through one end thereof and connected to the valve spool 142. The opposite end of the valve sleeve 140 is closed by an end plug 146. A valve return spring 148 is disposed in the valve sleeve 140 between the end plug 146 and the valve spool 142. The end plug 146 is formed with a drain opening 150.

For fluid connection of the control valve 90 with the inclined internal passage 108 and with two internal passages 116 and 118, the bushing 96 is formed with an inlet radial hole 154 and two outlet axial cutouts 156 and 158 as shown in FIGS. 4 and 5. Two outlet axial cutouts 156 and 158 are diametrically opposed to each other, while the inlet hole 154 is situated axially distant from the outlet axial cutouts 156 and 158 and equi-angularly displaced from thees cutout 156 and 158 in relation to an axis of the bushing 96. The two diametrically opposed axial cutouts 156 and 158 are open to and thus in fluid communication with the adjacent ends of the internal passages 116 and 118, respectively. However, the inlet hole 154 is not open to the adjacent end of the inclined internal passage 108 (see FIG. 5). Thus, in order to establish fluid communication between the inlet hole 154 and the inclined internal passage 108, a passage 160 is formed in the integral boss 92.

The valve sleeve 140 is received in the bushing 96 and formed with an inlet port 162 in registry with the inlet hole 154 of the bushing 96 and an outlet circumferential groove 164 opening to the diametrically opposed axial cutouts 156 and 158 of the bushing 96. This circumferential outlet groove 164 communicates with an axial groove 166. With the bushing 96 disposed between the valve sleeve 140 and the bore 94, a fluid flow along the outer peripheral wall of the valve sleeve 140 from the inlet port 162 to the outlet circumferential groove 164 and the axial groove 166 is blocked. The bottom wall of the outlet circumferential groove 164 is apertured to provide at least one outlet port 168.

Figure 7:
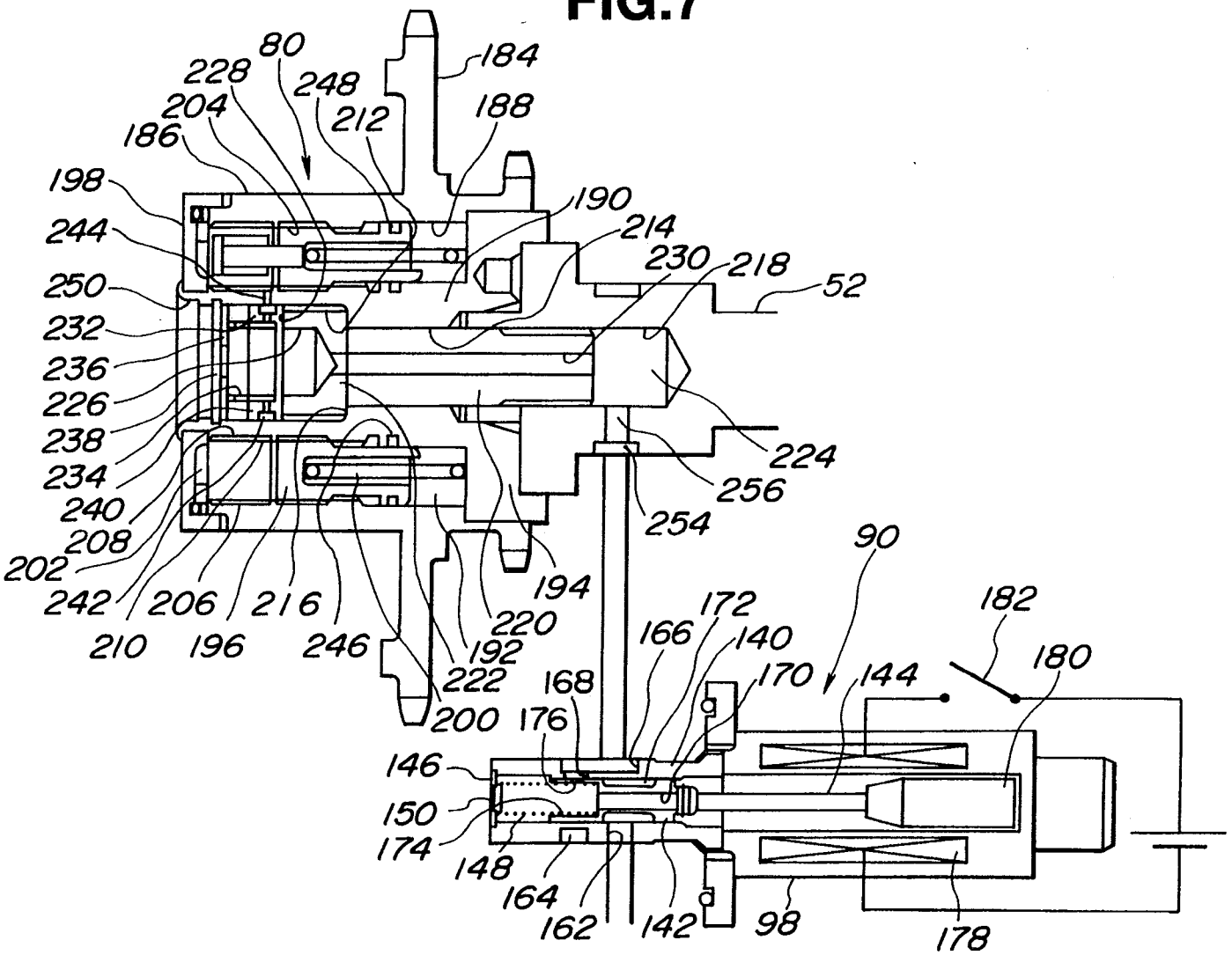
FIG. 7 is a diagram showing component parts, namely, a hydraulically actuable valve operation mode control actuator and a solenoid actuable control valve, of a valve timing control system in a first state.
Figure 8:
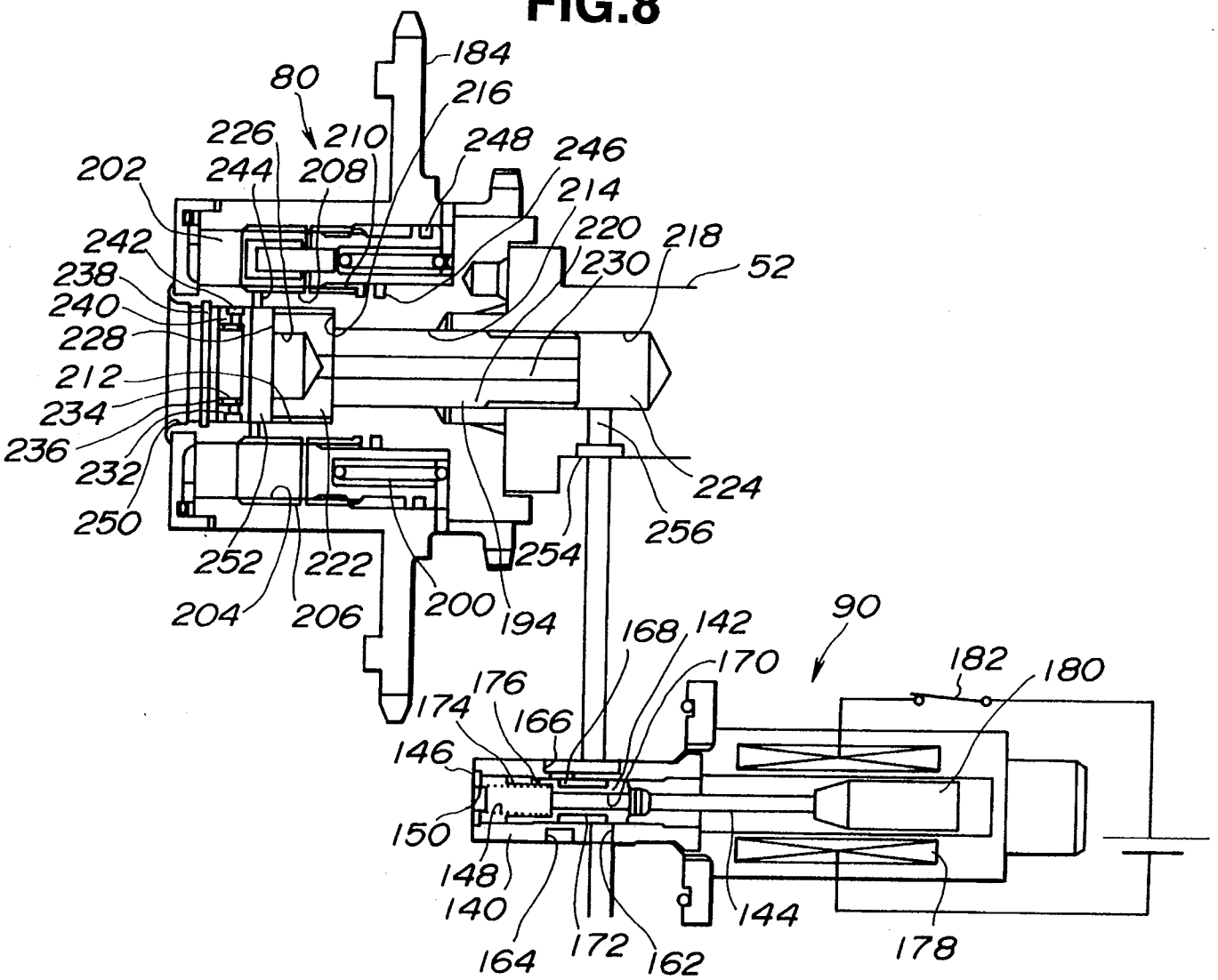
FIG. 8 is a diagram showing the component parts of the valve timing control system in a second state.

The outlet port 168 is allowed to communicate with the drain opening 150 when the valve spool 142 assumes a first position thereof as illustrated in FIG. 7, while when the valve spool 142 assumes a second position thereof as illustrated in FIG. 8, the outlet port 168 is allowed to communicate with the inlet port 162. Referring to FIG. 7, the valve spool 142 is formed with an axial through bore 170 having one end closed by the plunger 144 of the solenoid actuator 98. The opposite end of the axial through bore 170 is open and opposed to the drain opening 150 of the end plug 146. The valve spool 142 is formed with a circumferential groove 172. Extending axially from the remote axial end of the valve spool 142 from the plunger 144 is an integral sleeve 174 in which the valve return spring 148 is received. The integral sleeve 174 is formed with a radial hole 176 adapted to mate with the outlet port 168.

The solenoid actuator 98 includes a solenoid 178 surrounding a core 180 fixed to the plunger 144. The solenoid 178 is energized when a switch 182 is closed. Closing the switch 182 causes electric current to pass through the solenoid 178 to energize same. The energization of the solenoid 178 causes the plunger 98 to push the valve spool 142 against the valve return spring 148 for movement from the first position thereof as illustrated in FIG. 7 to the second position thereof as illustrated in FIG. 8.

The inlet port 162 of the valve sleeve 140 is always open to the circumferential groove 172 of the valve spool 142. The width, i.e., a dimension along the longitudinal direction of the valve spool 142, of this circumferential groove 172 is wide enough to allow fluid communication between the axially spaced inlet port 162 and the outlet port 168 when the valve spool 142 assumes the second position as illustrated in FIG. 8.

In the first position of the valve spool 142 as illustrated in FIG. 7, the radial hole 176 of the integral sleeve 174 is in fluid communication with the outlet port 168 of the valve sleeve 140, while the circumferential groove 172 is out of fluid communication with the outlet port 168. Under this condition, hydraulic fluid from the outlet port 168 is discharged via the drain opening 150 of the end plug 146. In the second position of the valve spool 142 as illustrated in FIG. 8, the radial hole 176 is out of fluid communication with the outlet port 168, while the circumferential groove 172 is in fluid communication with the outlet port 168. Under this condition, hydraulic fluid from the inlet port 162 is supplied to the outlet port 168.

The hydraulically actuable valve operation mode control actuators, one being shown at 80 in FIG. 3, are of the same design. This design is now explained in connection with FIGS. 7 and 8.

Referring to FIG. 7, the hydraulically actuable valve operation mode control actuator 80 includes a cam sprocket 184. The cam sprocket 184 has a hub 186 formed with a cylindrical wall 188. Rotatably disposed in the hub 186 is a sleeve 190 fixedly attached to the intake camshaft 52. The sleeve 190 is radially spaced from the cylindrical wall 188 to define therebetween an annular bore 192. The sleeve includes a radial extension 194 closing one end of the annular bore 192. An annular piston 196 is disposed in the annular bore 192. The opposite end of the annular bore 192 is closed by an annular hub cap 198. A piston return spring 200 is disposed in the annular bore 192 between the radial extension 194 and the adjacent end of the annular piston 196. The piston return spring 200 biases the annular piston 196 toward the hub cap 198, causing the annular piston 196 to assume a first or spring set position thereof as illustrated in FIG. 7. The annular piston 196 has an axial end opposed to the hub cap 198, defining a servo chamber 202 within said annular bore 192 between the annular piston 196 and the hub cap 198. In operation, the annular piston 196 is urged to move against the piston return spring 200 toward the radial extension 194 in response to a pressure build-up in the servo chamber 202 until it assumes a second position thereof as illustrated in FIG. 8.

For causing an angular displacement of the sleeve 190 fixed to the camshaft 52 relative to the cam sprocket 184, the cylindrical wall 188 is formed with a helical gear at 204 which is engaged with a mating helical gear 206 with which the outer periperal wall of the annular piston 196 is formed, while the inner peripheral wall of the annular piston 196 is formed with a helical gear at 208 which is engaged with a helical gear 210 with which the outer periperal wall of the sleeve 190 is formed. Owing to this helical gear arrangement, movement of the annular piston 196 from the first position as illustrated in FIG. 7 to the second position thereof as illustrated in FIG. 8 causes the sleeve 190 and thus the camshaft 52 to displace angularly relative to the cam sprocket 184 by a predetermined angle. Reverse movement of the annular piston 196 from the second to the first position thereof causes the sleeve 190 and the camshaft 52 to angularly displace in the reverse direction as to reduce the angular displacement to zero.

The manner of controlling pressure within the servo chamber 202 is now explained. As shown in FIGS. 7 and 8, the sleeve 190 has an enlarged diameter bore section 212 and a reduced diameter bore section 214. The enlarged diameter bore section 212 is open at one end of the sleeve 190 adjacent the hub cap 198, while the reduced diameter bore section 214 is open at the opposite end of the sleeve 190 adjacent the camshaft 52. The enlarged diameter bore section 212 is connected via an annular shoulder 216 to the reduced diameter bore section 214 which is in turn connected to a blind axial bore 218 with which the camshaft 52 is formed. Extending through the reduced diameter bore section 214 and received in the blind bore 218 is an insert 220. At one end, the insert 220 has a radially extended head portion 222 disposed in the enlarged diameter bore section 212. The insert 220 has its opposite end opposed to and spaced from the end of the blind bore 218 to define a chamber 224 within the blind bore 218. The radially extended head portion 222 of the insert 220 is formed with a center recess 226 edged by an annular area 228. The insert 220 is formed with a small diameter through bore 230 having one end open at the bottom of the center recess 226 and the opposite end opening to the chamber 224 in the blind bore 218. A piston 232 is disposed in the enlarged diameter bore section 212 of the sleeve 190 and held in abutting engagement with the annular area 228 of the radially extended head portion 222 of the insert 220. The return spring 234 has one end bearing against an annular spring retainer 236 held in position by a snap ring 238 clamped into the sleeve 190. The piston 232 has an integral sleeve 240 receiving the return spring 234. The integral sleeve 240 of the piston 232 is formed with a circumferential groove 242. This groove 242 has its bottom apertured to open within the inner peripheral wall of the sleeve 240 surrounding the return spring 234. The sleeve 190 is formed with a radial port 244 having its radially outer end opening within the healical gear 210 and its radially inner end opening within the inner peripheral wall of the sleeve 190 defining the enlarged diameter bore section 212. Fluid flow communication between this radial port 244 and the servo chamber 202 is established through spaces formed between the helical gears 208 and 210 and spaces formed between the helical gears 204 and 206. Fluid flow communication between the radial port 244 and a drain space accommodating the piston return spring 200 is blocked by inner and outer seal rings 246 and 248.

When the piston 232 assumes a first spring set position as illustrated in FIG. 7, the circumferential groove 242 is in communication with the radial port 244. Under this condition, hydraulic fluid is discharged via a drain opening 250 at the one end of the sleeve 190. Explaining the path of discharge flow, the flow of hydraulic fluid from the servo chamber 202 passes through the helical gear arrangement, radial port 244, circumferential groove 242 and annular spring retainer 236. In response to a pressure build-up in the center recess 226, the piston 232 is urged against the return spring 234 for movement from the first spring set position as illustrated in FIG. 7 to a second position as illustrated in FIG. 8.

When the piston 232 assumes the second position as illustrated in FIG. 8, the circumeferential groove 242 is out of fluid communication with the radial port 244 and the radial port 244 is open to a chamber 252 defined between the piston 232 and the head portion 222 of the insert 220. Under this condition, hydraulic fluid from the center recess 226 flows through the chamber 252, radial port 244 and the helical gear arrangement to the servo chamber 202, resulting in an increase in pressure within the servo chamber 202.

As will be readily understood from FIG. 7, the supply of hydraulic fluid to and discharge thereof from the chamber 224 in the blind bore 218 is accomplshed by a circumferential groove 254 into which the internal passage 120 or 122 of the cylinder head 36 or 38 is open. Fluid connection between this circumferential groove 254 and the blind bore 218 is established by a radial passage 256.

Referring to FIGS. 4, 5 and 7, let us assume that the switch 182 is open during operation of the engine.

Hydraulic fluid, under pressure, from a pump, not shown is kept supplied to the main gallery 88 via a filter, not shown, in the conventional manner. Since the pipe 106 interconnects the main gallery 88 and the boss 92 of the casing 84, the pressurized hydraulic fluid fills in the inclined passage 108, passage 160, inlet radial hole 154, inlet port 162 and circumferential groove 172 of the valve spool 142 of the control valve 90. As shown in FIG. 7, the circumferential groove 172 is out of fluid communication with the outlet circumferential groove 164. The outlet circumferential groove 164 is in fluid communication with the drain opening 150. Thus, the center recess 226, small diameter through bore 230, chamber 224 in the blind bore 218, radial passage 256, circumferential groove 254, internal passages 120 and 122 (see FIG. 2) of the cylinder heads 36 and 38, internal passages 116 and 118 of the casing 84 are drained via the drain opening 150. Since the radial port 244 is in fluid communication with the drain opening 250, the servo chamber 202 drained via the drain opening 250.

Let us consider a shift from the state as illustrated in FIG. 7 to the state as illustrated in FIG. 8. This shift is initiated by closing the switch 182. The closing of the switch 182 causes energization of the solenoid 178. This energization of the solenoid 178 causes movement of the valve spool 142 from the position as illustrated in FIG. 7 to the position as illustrated in FIG. 8. During this movement of the valve spool 142, the fluid communication between the outlet circumferential groove 164 and the drain opening 150 is blocked and the circumferential groove 172 of the valve spool 142 is brought into fluid communication with the outlet circumferential groove 164 of the valve sleeve 140. This allows the hydraulic fluid to fill in the internal passages 116 and 118 of the casing 84, and internal passages 120 and 122 of the cylinder heads 36 and 38. Hydraulic fluid from each of the internal passages 120 and 122 fills in the circumferential groove 254, radial passage 256, chamber 224, small. diameter through bore 230 and center recess 226 of the corresponding hydraulically actuable valve operation mode control actuator 80. Owing to pressure build-up in the center recess 226, the piston 232 moves from the position as illustrated in FIG. 7 to the position as illustrated in FIG. 8. During this movement of the piston 232, the fluid communication between the radial port 244 and the drain opening 250 is blocked and the radial port 244 is brought into fluid communication with the chamber 252 formed between the piston 232 and the head portion 222 of the insert 220. Then, the hydraulic fluid is supplied to the servo chamber 202 via the radial port 244. This causes an increase in pressure within the servo chamber 202. This pressure increase within the servo chamber 202 causes the annular piston 196 to move against the piston return spring 200 from the postion as illustrated in FIG. 7 to the position as illustrated in FIG. 8. This movement of the annular piston 196 causes the camshaft 52 to angularly displace relative to the cam sprocket 184 by the predetermined angle.

Let us now consider a shift to the state as illustrated in FIG. 7 from the state as illustrated in FIG. 8. This shift is initiated by opening the switch 182. Opening the switch 182 causes deenergization of the solenoid 178. This deenergization of the solenoid 178 allows the valve return spring 148 to push the valve spool 142 for movement from the position as illustrated in FIG. 8 to the position as illustrated in FIG. 7. During this movement of the valve spool 142, the fluid communication between the outer circumferential groove 164 and the circumferential groove 172 of the valve spool 142 is blocked and the outlet circumferential groove 164 is brought into fluid communication with the drain opening 150 of the end plug 146. This initiates discharge of hydraulic fluid from the chamber 252, causing a decrease in pressure within the chamber 252. This pressure decrease within the chamber 252 allows the piston 232 to move owing to bias of the return spring 234 from the position as illustrated in FIG. 8 to the position as illustrated in FIG. 7. During this movement of the piston 232, the fluid communication between the radial port 244 and the chamber 252 is blocked and the radial port 244 is brought into fluid communication with the drain opening 250. This causes discharge of hydraulic fluid from the servo chamber 202, causing a decrease in pressure within the servo chamber 202. This pressure decrease within the servo chamber 202 allows the annular piston 196 to move owing to bias of the piston return spring 200 from the position as illustrated in FIG. 8 to the position as illustrated in FIG. 7. This movement of the annular piston 196 causes the camshaft 52 to angularly displace relative to the cam sprocket 184 by the predetermined angle in such a direction as to decrease the angular displacement toward zero.

From the preceding description of the first embodiment, it will now be seen that since all of the hydraulically actuable valve operation mode control actuators are controlled by the commmon control valve 90 disposed in the space between the two cylinder banks 20 and 28, the installation of this system does not cause any increase in size of the V-type internal combustion engine. This is particularly advantageous when mounting the V-type internal combustion engine within an engine compartment of an automobile laterally with respect to a longitudinal direction of the automobile vehicle. Im FIGS. 1 and 6, arrows indicated by F denote a running direction of the automobile.

From the preceding description, it will be noted that, owing to a single passageway including the external pipe 106, the common control valve 90 fluidly connected to the main gallery 88. It will also be noted that a fluid passageway, i.e., the internal passage 120 and bore 128, of the cylinder head 36 and a fluid passageway, i.e., the internal passage 122 and bore 132, of the cylinder head 38 are simplified, shortened and easy to machine. This fluid network ensures synchronous operation of the hydraulically actuable valve operation mode control actuators. Besides, the control valve 90 prevents the single passageway including the pipe 106 from communicating with any of the drain openings 150 and 250. Thus, no modification of the existing pump is necessary.

Owing to the control valve 90 fluidly disposed between the gallery 88 and the hydraulically actuable valve operation mode control actuators, the response time is shortened.

According to the first embodiment, since the external pipe 106 is disposed adjacent the solenoid actuator 98 of the control valve 90, it is confirmed that there is positive effect on dropping temperature in the ambient air around the solenoid actuator 98.

According to the first embodiment, the external pipe 106 is responsible for the supply of hydraulic fluid from the main gallery 88 to the control valve 90. Alternatively, a flow of hydraulic fluid from the main gallery 88 may pass through an internal passage of the cylinder block, an internal passage and a bore of the cylinder head 36 and a passage formed in the casing 84. Alternatively, this flow may pass through an internal passageway formed through a sub-block interconnecting the cylinder block and the integral boss 92.

Referring to FIGS. 9 to 15, the second embodiment is described. Briefly, this embodiment is similar to the first embodiment in that a single control valve is disposed between a main gallery and two hydraulically actuable valve operation mode control actuators for intake camshafts arranged for first and second cylinder banks, respectively. However, a difference resides in the fact that according to the second embodiment, the control valve is fluidly disposed also between the main gallery and two hydraulically actuable valve operation mode control actuators for exhaust camshafts arranged for the first and second cylinder banks, respectively. Another difference resides in an internal fluid connection between the main gallery 88 and the control valve. Owing to the internal fluid connection according to this embodiment, instllation work of an external pipe becomes unnecessary.

Figure 9:
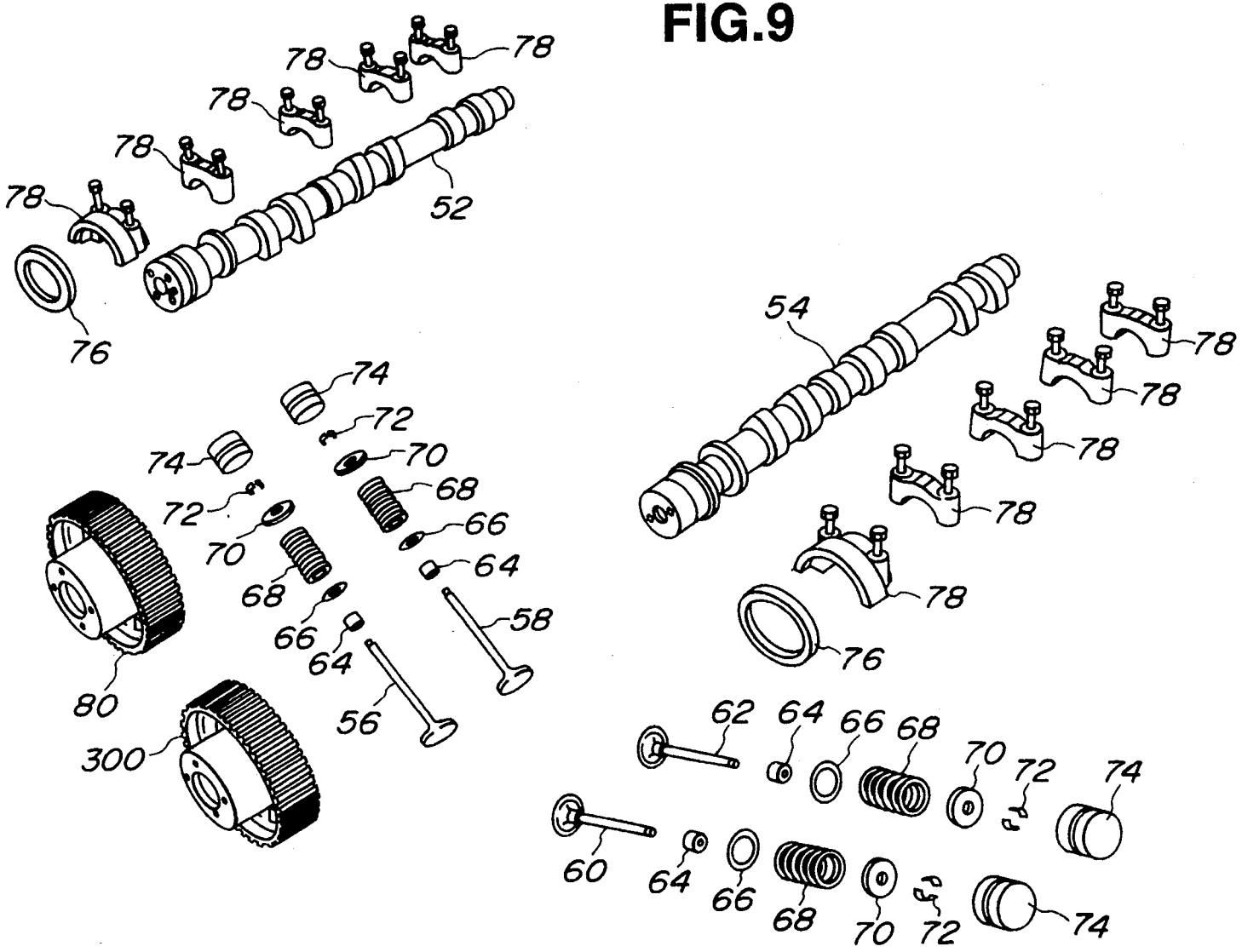
FIG. 9 is a similar view to FIG. 3, showing a modified valve drive mechanism.

According to the second embodiment, four hydraulically actuable valve operation mode control actuators are needed. Among them, two hydraulically actuable valve operation mode control actuators, only one being shown at 80 in FIG. 9, are coupled with the corresponding one intake camshaft 52, while the other two hydraulically actuable valve operation mode control actuators, only one being shown at 300 in FIG. 9, are coupled with the corresponding one, exhaust camshaft 54. A hydraulic fluid network is fluidly disposed between a main gallery 88 and the two hydraulically actuable valve operation mode control actuators, only one being shown at 80 in FIG. 9, coupled with the intake camshafts, only one being shown at 52 in FIG. 9, for the first and second cylinder banks 20 and 28 (see FIG. 1), and between the main gallery 88 and the other two hydraulically actuable valve operation mode control actuators, only one being shown at 300 in FIG. 9, coupled with the exhaust camshafts, only one being shown at 54 in FIG. 9, for the first and second cylinder banks 20 and 28. The four hydraulically actuable valve operation mode control actuators are the same, in construction and design, as their counterparts in the first embodiment.

The hydraulic fluid network includes a control valve 310 which is explained later in connection with FIGS. 13, 14 and 15.

Figure 10:
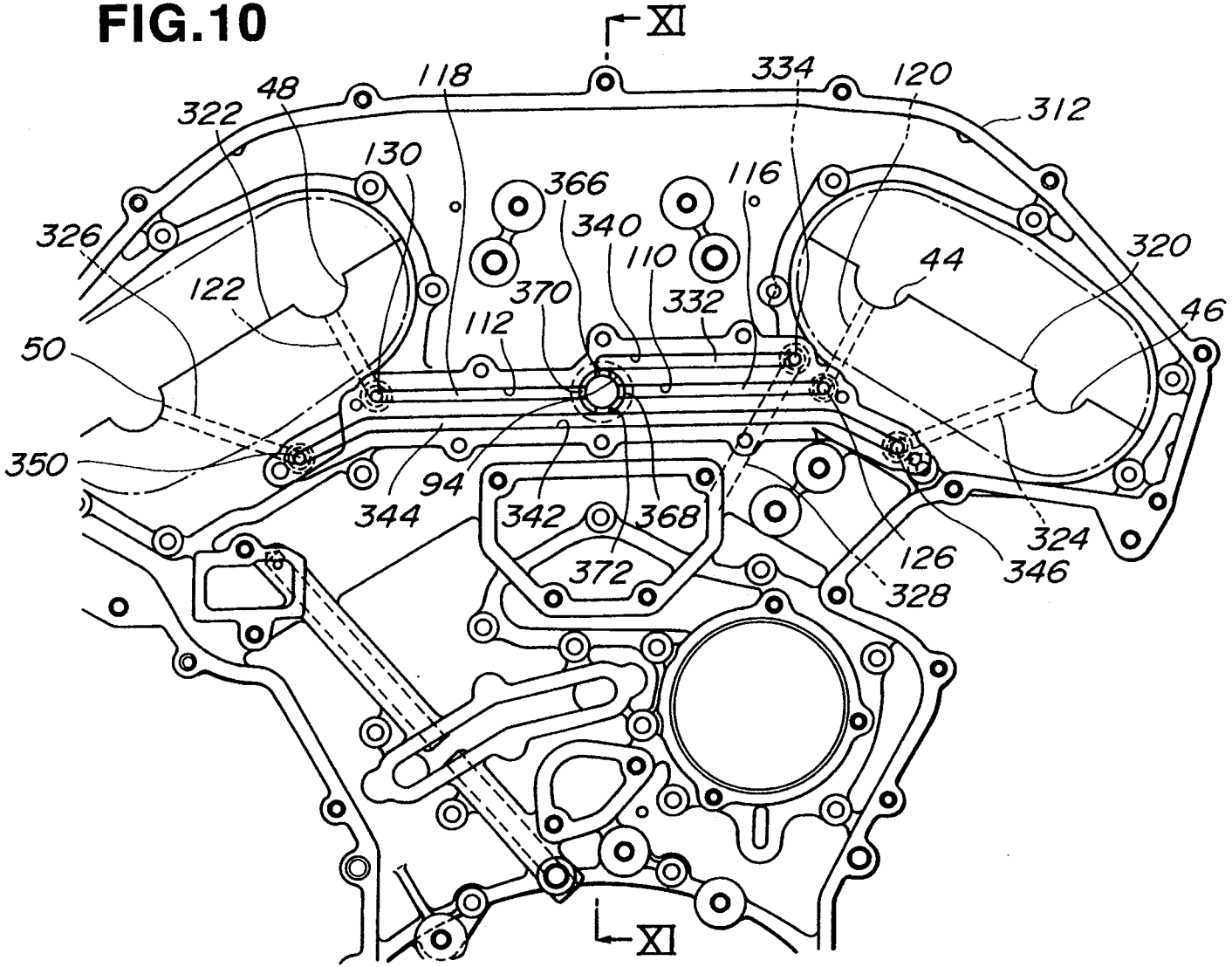
FIG. 10 is a similar view to FIG. 4, showing a casing so modified as to fit the valve drive mechanism shown in FIG. 9.
Figure 11:
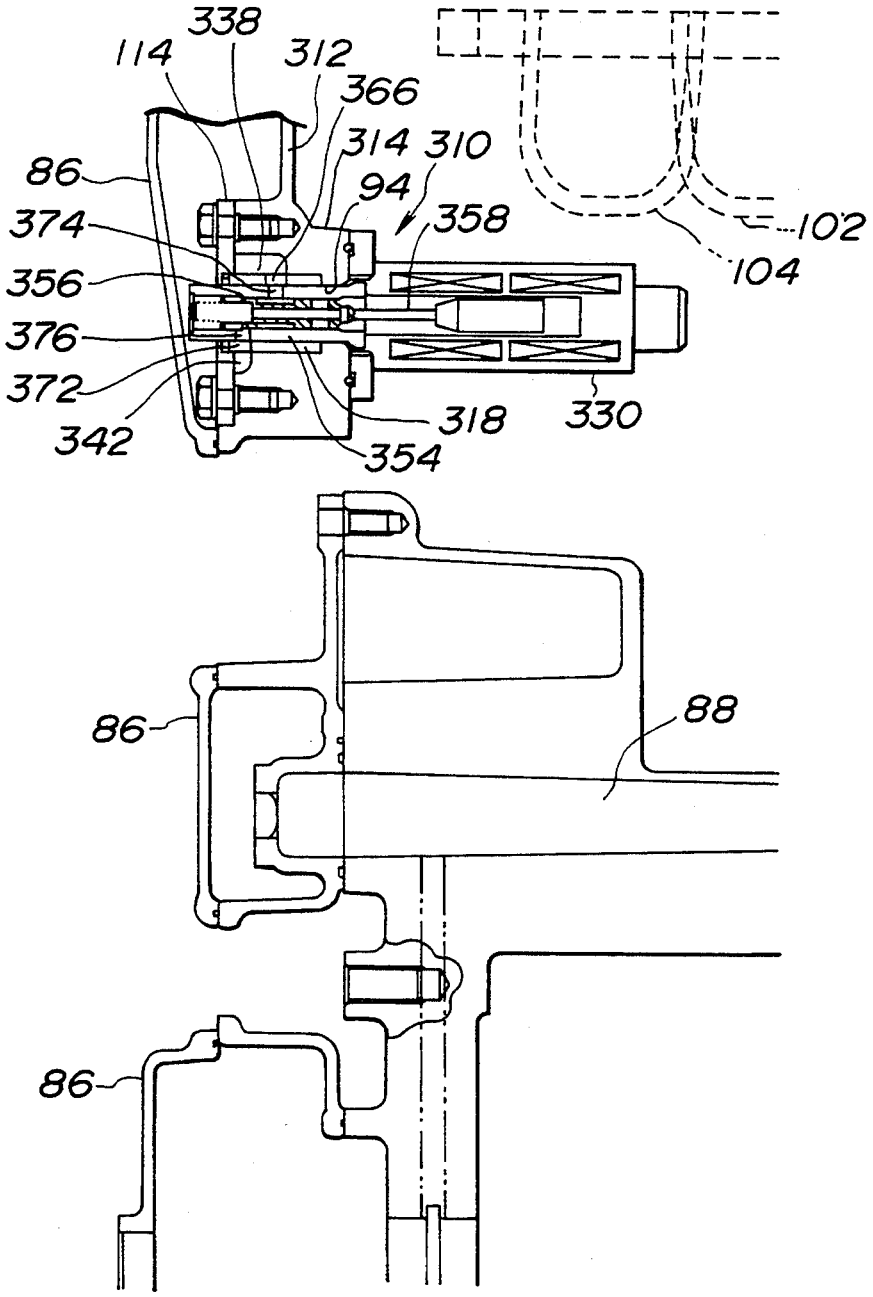
FIG. 11 is a diagram showing a section taken through the line XI—XI of FIG. 10.

As best seen in FIG. 11, the control valve 310 is attached to a casing 312 and disposed between the first and second cylinder banks 20 and 28 (see FIG. 1). The casing 312 is of the similar design to the casing 84 used in the first embodiment. Specifically, the casing 312 has an integral boss 314 formed with a stepped bore 94 receiving therein the control valve 310 via a bushing 318. As is seen from FIGS. 10 and 11, the integral boss 314 is situated equi-distant from first and second cylinder heads 320 and 322 (see FIG. 12). The cylinder heads 320 and 322 are similar to the cylinder heads 36 and 38 used in the first embodiment and shown in FIG. 2. Thus, the same reference numerals as used in FIG. 2 are used in FIGS. 10 and 12 to denote similar portions and parts. However, as different from their counterparts, the cylinder heads 320 and 322 are formed with inclined internal passages 324 and 326, respectively, and the cylinder head 320 is also formed with an internal passage 328 for fluid connection with the main gallery 88.

Referring to FIGS. 10 and 11, the control valve 310 includes a solenoid actuator 330. The solenoid actuator 320 is disposed in a space between the cylinder heads 322 and 322 above a cylinder block 10 (see FIG. 1) in the same manner as the solenoid actuator 98 is.

In order to supply hydraulic fluid to the control valve 310, the hydraulic fluid network includes the internal passage 328 of the cylinder head 320 and an internal passage 332 of the casing 312. As shown in FIG. 10, the internal passage 332 of the casing 312 is fluidly connected to the internal passage 328 of the cylinder head 328 by a port 334 aligned with a bore 336 of the cylinder head 320. As best seen in FIG. 11, the integral boss 314 is formed with a passage 338. As seen in FIG. 10, the casing 312 is formed with a groove 340 extending from this passage 338 towards the cylinder head 320. The bottom of this groove 340 is formed with the port 334. The groove 340 is covered by a cover 114 (see FIG. 11) to form the internal passage 332.

Fluid connection between the control valve 310 and sites 44 and 48 rotatably supporting the intake camshafts is substantially the same as its counterpart in the first embodiment and shown in FIG. 4. Thus, its detail description is hereby omitted. Fluid connection between the control valve 310 and sites 46 and 50 rotatably supporting the exhaust camshafts is explained. As is readily seen from FIGS. 10 and 11, the casing 312 is formed with a common groove 342. This common groove 342 has a straight portion extending along an imaginary line tangential to the stepped bore 94. The common groove 342 extends away from the stepped bore 94 towards the cylinder head 320, on one hand, and towards the other cylinder head 322, on the other hand. The common groove 342 is covered by the cover 114 (see FIG. 11) to form an internal common passage 344. Referring to FIG. 10, the internal common passage 344 of the casing 312 communicates with the internal inclined passages 324 and 326 of the cylinder heads 320 and 322 (see FIG. 12). Connection between the internal common passage 344 of the casing 312 and the internal passage 324 of the cylinder head 320 is accomplished by aligning a port 346 with a bore 348 (see FIG. 12), while connection between the internal common passage 344 of the casing 312 and the internal passage 326 of the cylinder head 322 is accomplished by aligning a port 350 with a bore 352 (see FIG. 12).

Referring to FIG. 11, the control valve 310 includes a valve sleeve 354 and a valve spool 356. The solenoid actuator 330 has a plunger 358 inserted into the valve sleeve 354 through one end thereof and connected to the valve spool 356. As best seen in FIG. 13, the opposite end of the valve sleeve 354 is closed by an end plug 360. A valve return spring 362 is disposed in the valve sleeve 354 between the end plug 360 and the valve spool 356. The end plug 360 is formed with a drain opening 364.

For fluid connection of the control valve 310 with the internal passage 332, with the two internal passages 116 and 118 and with the internal common passage 344, the bushing 318 is formed with an inlet radial hole 366 in fluid communication with the passage 338 which is in turn connected to the internal passage 332, two outlet axial cutouts 368 and 370 in fluid communication with the internal passages 116 and 118, respectively, and an outlet radial hole 372 in fluid communication with the internal common passage 344 as shown in FIGS. 10 and 11. As readily seen from FIG. 11, the inlet radial hole 366 is disposed within a radial plane of the bushing 318 axially distant from a radial plane thereof where the third outlet radial hole 372 is disposed. The radial holes 366 and 372 are angularly displaced in respect of the axis of the bushing 318 by an angle of 180 degrees. The two outlet axial cutouts 368 and 370 are diametrially opposed and disposed within an axial plane of the bushing 318. This axial plane is angularly displaced in respect of the axis of the bushing 318 by an angle of 90 degrees from an axial plane where the inlet radial hole 366 and the outlet radial hole 372 are disposed.

As best seen in FIG. 11, the valve sleeve 354 is received in the bushing 318 and formed with an inlet port 374 in registry with the inlet radial hole 366 of the bushing 318 and an outlet port 376 in registry with the outlet radial hole 372 of the bushing 318. Referring also to FIG. 13, the valve sleeve 354 is formed also with a circumferential outlet groove 378. The circumferential outlet groove 378 is open to and thus in fluid communication with the two outlet cutouts 368 and 370 of the bushing 318. The bottom wall of the circumferential outlet groove 378 is apertured to provide at least one outlet port 380.

Figure 13:
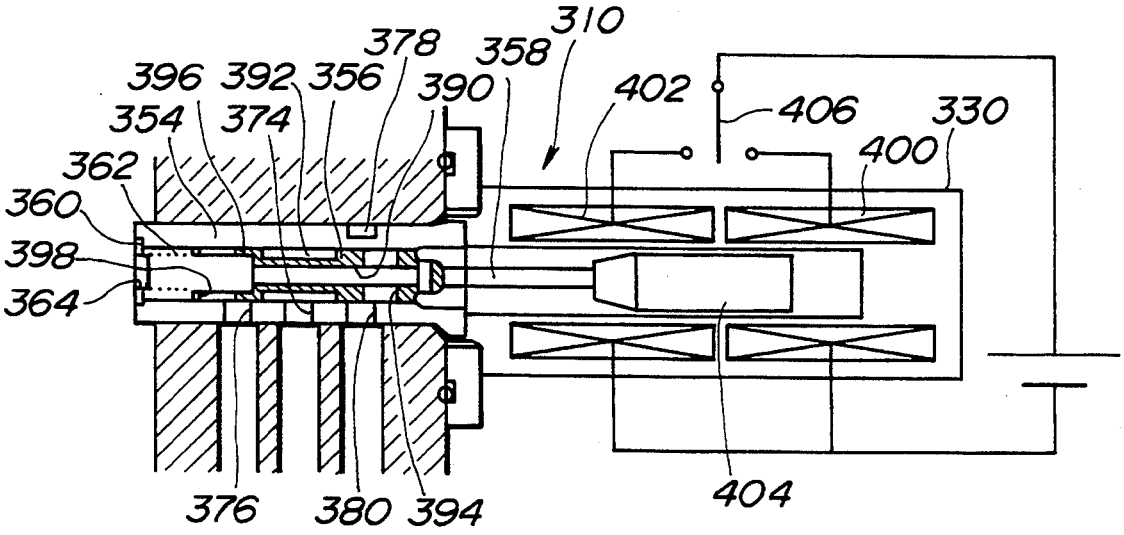
FIG. 13 is a modified control valve in a first state thereof.

This outlet port 380 and the outlet port 376 are allowed to communicate with the drain opening 364 when the valve spool 356 assumes a first position as illustrated in FIG. 13. When the valve spool 356 assumes a second position as illustrated in FIG. 14, the outlet port 380 is allowed to communicate with the inlet port 374, while the outlet port 376 is allowed to communicate with the drain opening 364. When the valve spool 356 assumes a third position as illustrated in FIG. 15, the outlet port 380 is allowed to communicate with the drain opening 364, while the outlet port 376 is allowed to communicate with the inlet port 374.

Referring to FIG. 13, the valve spool 356 is formed with an axial through bore 390 having one end closed by the plunger 358 of the solenoid actuators 330. The opposite end of the axial through bore 390 is open and opposed to the drain opening 364 of the end plug 360. The valve spool 356 is formed with a circumferential groove 392 and a radial bore 394. This radial bore 394 is disposed between the circumferential groove 392 and the plunger 358 and communicates with the axial through bore 390. Extending axially from the remote axial end of the valve spool 356 from the plunger 358 is an integral sleeve 396 in which the valve return spring 362 is received. The integral sleeve 396 is formed with a radial hole 398 adapted to mate with the outlet port 376.

The solenoid actuator 330 includes a first solenoid 400 and a second solenoid 402. Surrounded by the solenoids 400 and 402 is a core 404 fixed to the plunger 358. The first solenoid 400 is energized when a switch 406 assumes a first closed position as illustrated in FIG. 14, while the second solenoid 402 is energized when the switch 406 assumes a second closed position as illustrated in FIG. 15. When the switch 406 is open as illustrated in FIG. 13, both the first and second solenoids 400 and 402 are deenergized.

Figure 14:
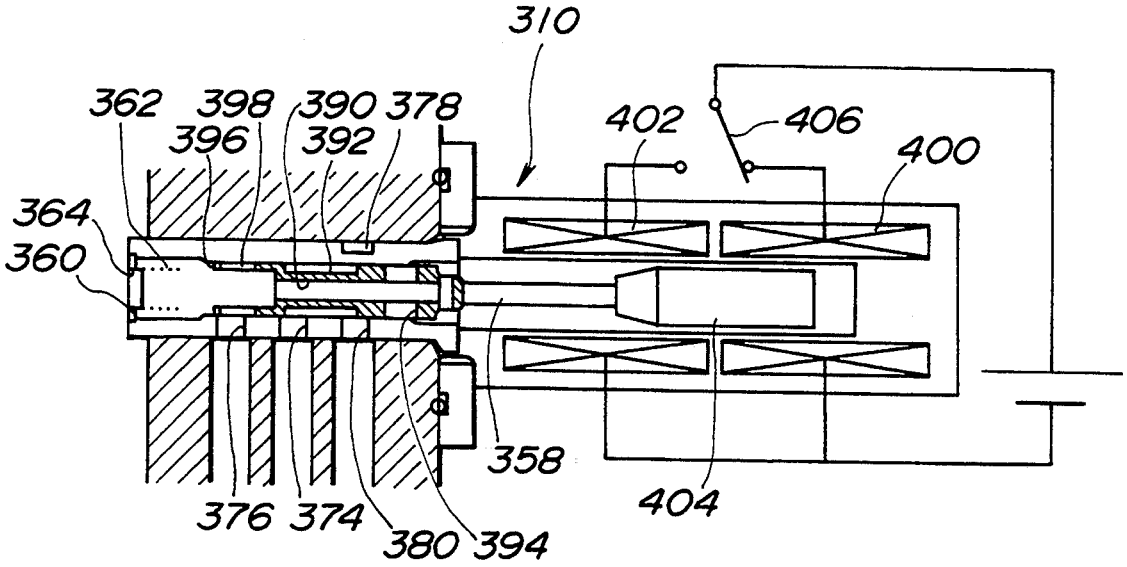
FIG. 14 is the modified control valve in a second state thereof.

Shifting the switch 406 from the open position as illustrated in FIG. 13 to the first closed position as illustrated in FIG. 14 causes electric current to pass through the first solenoid 400 to energize same. The energization of the solenoid 400 causes the plunger 358 to pull the valve spool 356 against a return spring, not shown, for movement from the first position thereof as illustrated in FIG. 13 to the second position thereof as illustrated in FIG. 14. Shifting the switch 406 from the open position as illustrated in FIG. 13 to the first closed position as illustrated in FIG. 14 causes electric current to pass through the second solenoid 402 to energize same. The energization of the second solenoid 402 causes the plunger 358 to push the valve spool 356 against the return spring 362 for movement from the first position thereof as illustrated in FIG. 13 to the third position thereof as illustrated in FIG. 15.

The inlet port 374 of the valve sleeve 354 is always open to the circumferential groove 392 of the valve spool 356. The width, i.e., a dimension along the longitudinal direction of the valve spool 356, of the circumferential groove 392 is wide enough to allow fluid communication between the inlet port 374 and the outlet port 380 when the valve spool 356 assumes the second position as illustrated in FIG. 14 and fluid communication between the inlet port 374 and the outlet port 376 when the valve spool 356 assumes the third position as illustrated in FIG. 15.

In the first position of the valve spool 356 as illustrated in FIG. 13, the radial bore 394 is in fluid communication with the outlet port 380 of the valve sleeve 354, the radial hole 398 of the integral sleeve 396 is in fluid communication with the outlet port 376 of the valve sleeve 354, and the circumferential groove 392 is out of fluid communication with the outlet ports 380 and 376. Under this condition, hydraulic fluid from the outlet port 380 is discharged via the drain opening 364 of the end plug 360 after having past the radial bore 394 and through bore 390 of the valve spool 356, and hydraulic fluid from the outlet port 376 is discharged via the drain opening 364 of the end plug 360 after having past the radial hole 398 of the integral sleeve 396.

In the second position of the valve spool 356 as illustrated in FIG. 14, the radial bore 394 is out of fluid communication with the outlet port 380, the radial hole 398 of the integral sleeve 396 is in fluid communication with the outlet port 376, and the circumferential groove 392 is in fluid communication with the outlet port 380. Under this condition, hydraulic fluid from the inlet port 374 is supplied to the outlet port 380, while hydraulic fluid from the outlet port 376 is discharged via the drain opening 364.

Figure 15:
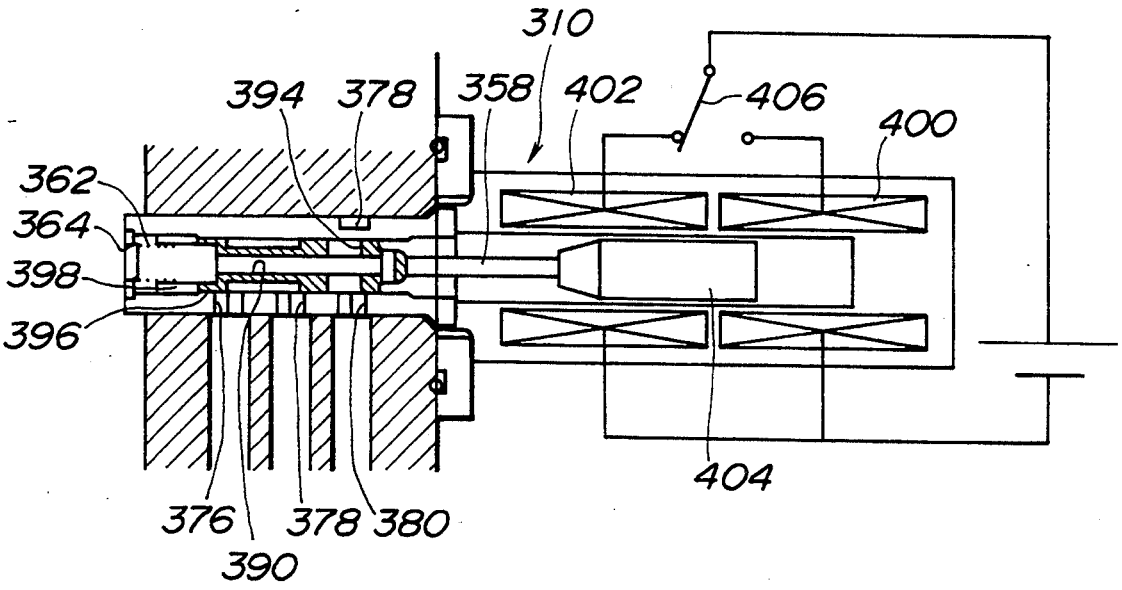
FIG. 15 is the modified control valve in a third state thereof.

In the third position of the valve spool 356 as illustrated in FIG. 15, the radial bore 394 is in fluid communication with the outlet port 380, the radial hole 398 of the integral sleeve 396 is in fluid communication with the outlet port 376, and the circumferential groove 392 is in fluid communication with the outlet port 376. Under this condition, hydraulic fluid from the inlet port 162 is supplied to the outlet port 376, while hydraulic fluid from the outlet port 380 is discharged via the drain opening 364.

The hydraulically actuable valve operation mode control actuators, one being shown at 300 in FIG. 9, for exhaust camshafts are of the same design as the hydraulically actuable valve operation mode control actuators which have been described in connection with FIGS. 7 and 8.

It is readily understood that when the switch 406 assumes the first closed position as illustrated in FIG. 14, the hydraulically actuable valve operation mode control actuators 80 for the intake camshafts 52 are pressurized, while the hydraulically actuable valve operation mode control actuators 300 for the exhaust camshafts 54 are drained.

When the switch 406 assumes the second closed position as illustrated in FIG. 15, the hydraulically actuable valve operation mode control actuators 80 for the intake camshafts 52 are drained, while the hydraulically actuable valve operation mode control actuators 300 for the exhaust camshafts 54 are pressurized.

When the switch 406 is open as illustrated in FIG. 13, all of the hydraulically actuable valve operation mode control actuators 80 and 300 are drained.

Figure 16:
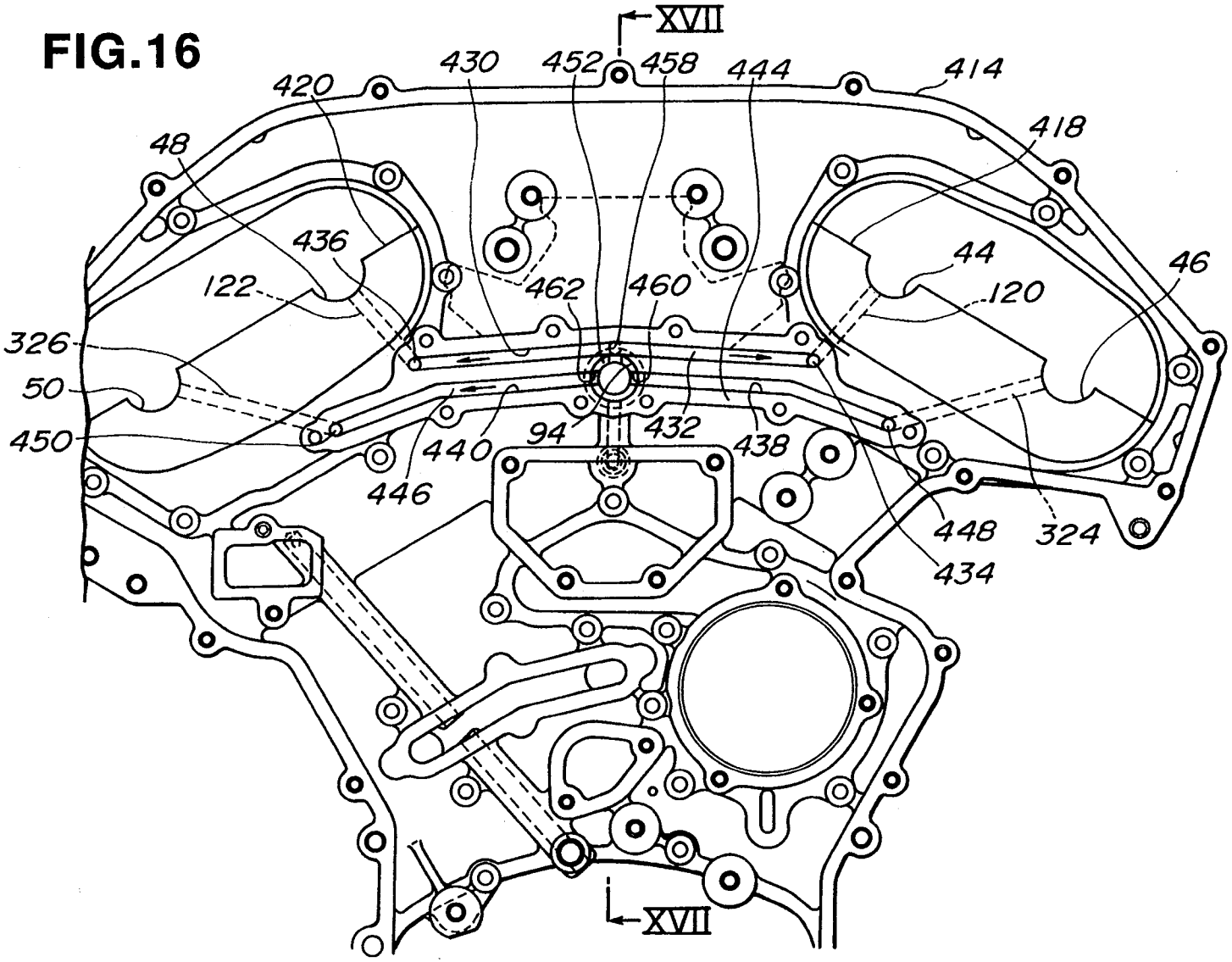
FIG. 16 is a diagram similar to FIG. 10 showing a further modified casing.
Figure 17:
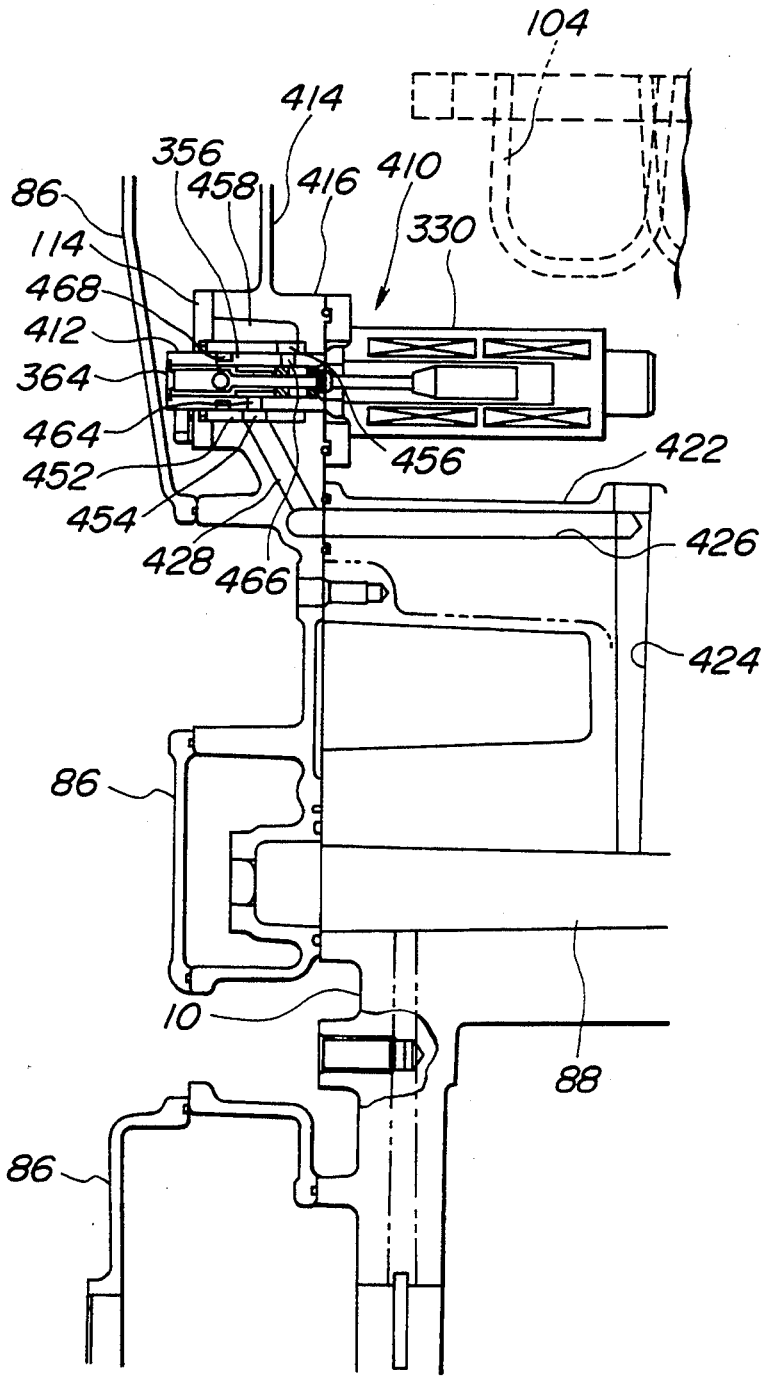
FIG. 17 is a diagram showing a section taken through the line XVII—XVII of FIG. 16.
Figure 18:
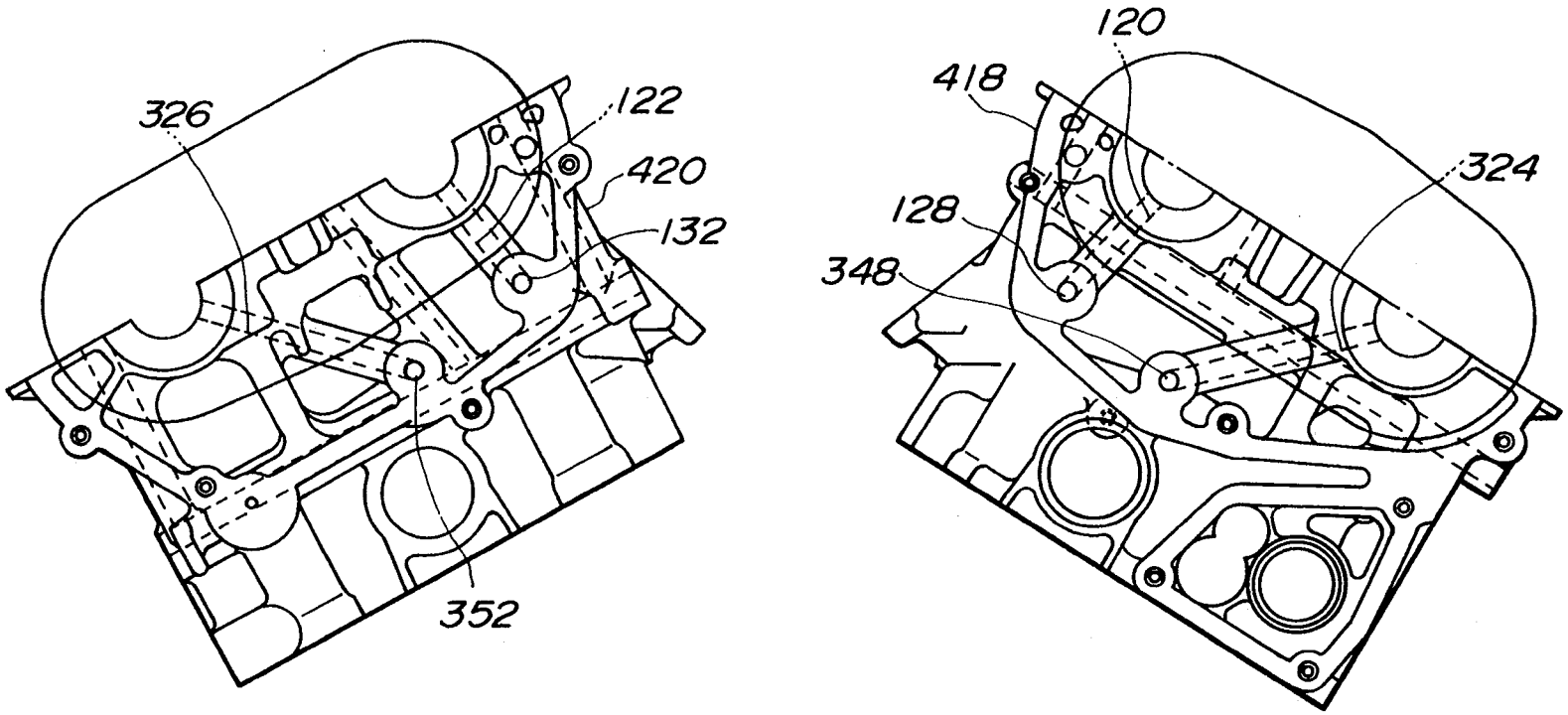
FIG. 18 is a diagram similar to FIG. 12 showing further modified cylinder heads.

Referring to FIGS. 16 to 18, the third embodiment is described. This embodiment is substantially the same as the second embodiment. However, this third embodiment is different from the second embodiment in that two hydraulically actuable valve operation mode control actuators for intake camshafts are fluidly connected to a control valve via an internal common passage of a casing and two hydraulically actuable valve operation mode control actuators for exhaust camshafts are fluidly connected to the same control valve by two internal passages of the casing. Another difference resides in that the internal fluid connection between the main gallery and the control valve is established through internal passage of a sub-block fixedly disposed between the cylinder block and the integral boss of the casing.

According to the third embodiment, a hydraulic fluid network is fluidly disposed between a main gallery and two hydraulically actuable valve operation mode control actuators, only one being shown at 80 in FIG. 9, coupled with the intake camshafts, only one being shown at 52 in FIG. 9, for the first and second cylinder banks 20 and 28 (see FIG. 1), and between the main gallery 88 and the other two hydraulically actuable valve operation mode control actuators, only one being shown at 300 in FIG. 9, coupled with the exhaust camshafts, only one being shown at 54 in FIG. 9, for the first and second cylinder banks 20 and 28.

This hydraulic fluid network includes a control valve 410 which is substantially the same in construction and operation as the control valve 310 used in the second embodiment. Referring to FIG. 17, the control valve 410 has a valve spool 356 and a solenoid actuator 330 which are the same in design as their counterparts of the control valve 310. However, the control valve 410 employs a valve sleeve 412 which is slightly modified as compared to its counterpart 354 of the control valve 310.

Figure 12:
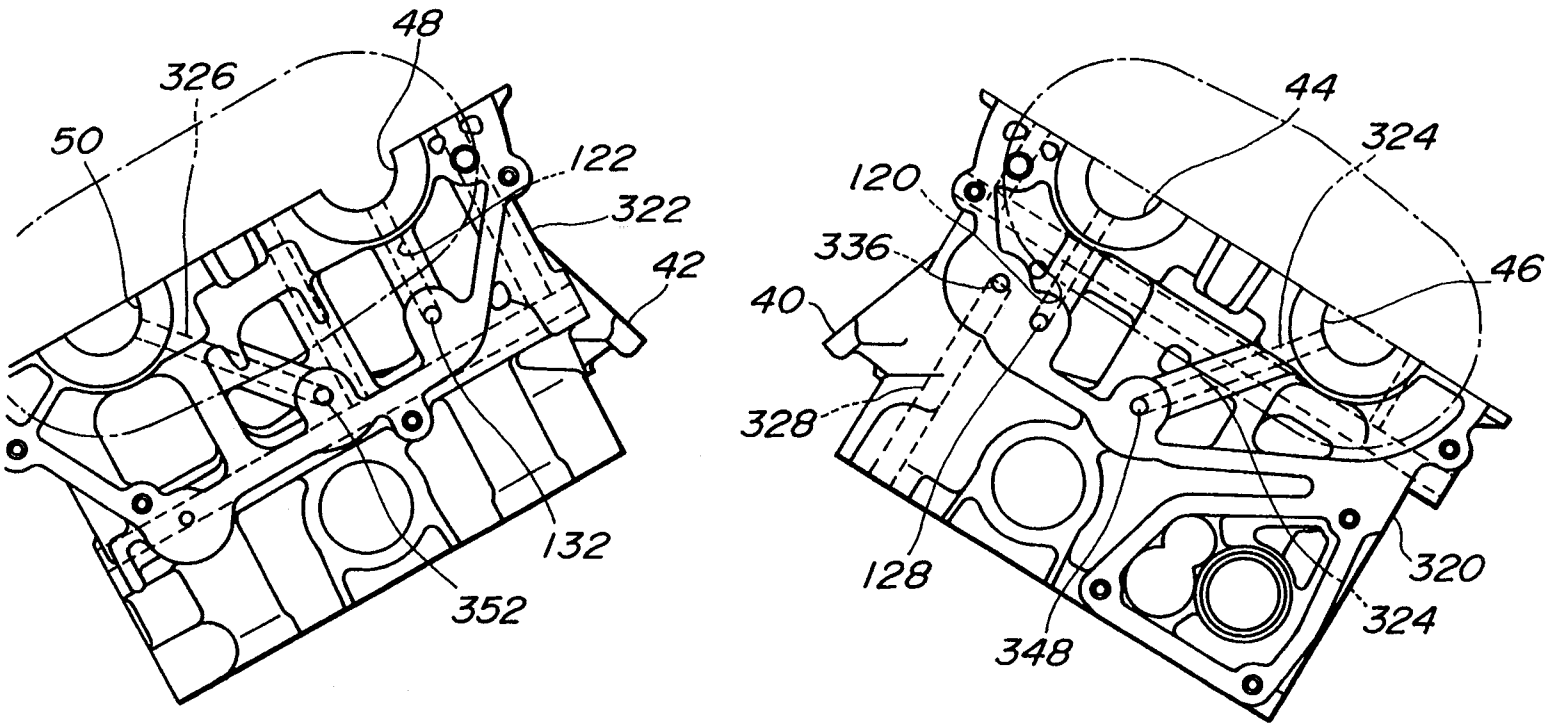
FIG. 12 is a diagram showing a front elevation of modified cylinder heads.

As shown in FIG. 17, the control valve 412 is attached to a casing 414 and disposed between the first and second cylinder banks 20 and 28 (see FIG. 1). The casing 414 is of the similar design to the casing 312 used in the second embodiment. Specifically, the casing 414 has an integral boss 416 which is formed with a stepped bore 94 in the same manner as the integral boss 314 of the casing 312. As is readily seen from FIGS. 16 and 18, the integral boss 416 is situated equi-distant from first and second cylinder heads 418 and 420. The cylinder heads 418 and 420 are similar to the cylinder heads 320 and 322 used in the second embodiment and shown in FIG. 12. Thus, the same reference numerals as used in FIG. 12 are used in FIGS. 16 and 18 to denote similar portions and parts. However, as different from its counterpart, the cylinder head 418 is not formed with an internal passage and a bore corresponding to the internal passage 328 and the bore 336 (see FIG. 12) of the cylinder head 320.

Referring to FIG. 17, in order to supply hydraulic fluid to the control valve 410, the hydraulic fluid network includes a sub-block 422 fixedly connected to a cylinder block 10 and the integral boss 416 of the casing 414. The sub-block 422 is formed with a passage 424 having one end communicating with the main gallery 88 and a sub-gallery 426 with which the opposite end of the passage 424 communicates. The integral boss 416 is formed with an inclined passage 428 having one end communicating with the sub-gallery 426.

Fluid connection between the control valve 410 and sites 44 and 48 rotatably supporting the intake camshafts and fluid connection between the control valve 410 and sites 46 and 50 rotatably supporting the exhaust camshafts are substantially the same as their counterparts in the second embodiment.

As is readily seen from FIG. 16, the casing 414 is formed with a common groove 430 which extends past the stepped bore 94. The common groove 430 extends away from the stepped bore towards the cylinder head 418, on one hand, and towards the other cylinder head 420, on the other hand. The common groove 430 is covered by a cover 114 (see FIG. 17) to form an internal common passage 432. This internal common passage 432 of the casing 414 communicates with internal passages 120 and 122 of the cylinder heads 418 and 420 (see FIG. 18). Connection between the internal common passage 432 and the internal passage 120 of the cylinder head 418 is accomplished by aligning a port 434 with a bore 128 (see FIG. 18), while connection between the internal common passage 344 of the casing 414 and the internal passage 122 of the cylinder head 420 is accomplsihed by aligning a port 436 with a bore 132 (see FIG. 18.

Referring to FIG. 16, the casing 414 is formed with two grooves 438 and 442 extending in the opposite directions from the stepped bore 94 towards the cylinder heads 418 and 420. These grooves 438 and 442 are covered by the cover 114 to form internal passages 444 and 446, respectively. The internal passages 444 and 446 of the casing 414 communicate with internal passages 324 and 326 of the cylinder heads 418 and 420, respectively. Connection between the internal passage 444 of the casing 414 and the internal passage 324 of the cylinder head 418 is accomplsihedby aligning a port 448 with a bore 348 (see FIG. 18), while connection between the internal passage 446 of the casing 414 and the internal passage 326 of the cylinder head 420 is accomplished by aligning a port 450 with a bore 352 (see FIG. 18).

For fluid connection of the control valve 410 with the inclined passage 428 (see FIG. 17), with the internal common passage 432 and with the two internal passages 444 and 446, a bushing 452 received in an enlarged diameter bore section of the stepped bore 94 is formed with an inlet radial hole 454 in fluid communication with the inclined passage 428, an outlet radial hole 456 in cluid communication with a passage 458 which is in turn connected to the internal common passage 432 (see FIGS. 16 and 17), and two axia cutouts 460 and 462 in fluid communication with the internal passages 444 and 446, respectively.

As best seen in FIG. 17, the valve sleeve 412 is received in the bushing 318 and formed with an inlet port 464 in registry with the inlet radial hole 454 of the bushing 452, and an outlet port 466 in registry with the outlet radial hole 456 of the bushing 452. Similarly to the outlet circumferential groove 164 and the outlet port 168 of the valve sleeve 140 used in the first embodiment (see FIGS. 5 and 7), the valve sleeve 412 is formed with an outlet circumferential groove 452 which has its bottom wall apertured to provide an outlet port (not shown) arranged to mate with a radial hole 398 of an integral sleeve 396 of the valve spool 356 (see FIG. 13). This outlet circumferential groove 468 is open to and thus in fluid communication with the two axial cutouts 460 and 462 of the bushing 452.

This circumferential groove 468 and the outlet radial port 466 are allowed to communicate with a drain opening when the valve spool 356 assumes a first position as illustrated in FIG. 13. When the valve spool 356 assumes a second position as illustrated in FIG. 14, the outlet port 466 is allowed to communicate with the inlet port 464, while the circumferential groove 468 is allowed to communicate with the inlet port 464. When the valve spool 356 assumes a third position as illustrated in FIG. 15, the outlet port 466 is allowed to communicate with the drain opening 364, while the circumferential groove 468 is allowed to communicate with the inlet port 464.

What is claimed is:

1. A V-type internal combustion engine, comprising:
first and second cylinder banks arranged to form the letter V;
a plurality of camshafts including two camshafts for said first and second cylinder banks, respectively;
a casing adapted to receive a drive system connecting said four camshafts to a crankshaft of the engine for turning said camshafts by rotation of the crankshaft;
a plurality of hydraulically actuable valve operation mode control actuators for said first and second cylinder banks;
a source of pressurized hydraulic fluid;
a hydraulic fluid network fluidly disposed between said source of pressurized hydraulic fluid and said plurality of hydraulically actuable valve operation mode control actuators;
said hydraulic fluid network including a control valve fluidly disposed between said source of pressurized hydraulic fluid and said plurality of hydraulically actuable valve operation mode control actuators;
said control valve being attached to said casing and disposed between said first and second cylinder banks; and
said casing having internal passage means forming a part of said hydraulic fluid network between said control valve and said plurality of hydraulically actuable valve operation mode control actuators.

2. A V-type internal combustion engine as claimed in claim 1, wherein said casing has an integral boss formed with a bore receiving therein said control valve.

3. A V-type internal combustion engine as claimed in claim 1, further comprising cooling means for reducing ambient temperature of said control valve.

4. A V-type internal combustion engine as claimed in claim 3, wherein said cooling means is in the form of an intake manifold connecting to said first and second cylinder banks.

5. A V-type internal combustion engine as claimed in claim 4, wherein said intake manifold has branch pipes extending through an area adjacent said control valve.

6. A V-type internal combustion engine as claimed in claim 2, wherein said control valve includes a solenoid actuator disposed between said first and second cylinder banks and equi-distant therefrom.

7. A V-type internal combustion engine as claimed in claim 1, wherein said plurality of hydraulically actuable valve operation mode control actuators are coupled with said two camshafts, respectively.

8. A V-type internal combustion engine as claimed in claim 1, wherein said plurality of camshafts include two intake camshafts for said first and second cylinder banks, respectively, and two exhaust camshafts for said first and second cylinder banks, respectively, and wherein said plurality of hydraulically actuable valve operation mode control actuators are divided into and consist of a first pair coupled with said two intake camshafts, respectively, and a second pair coupled with said two exhaust camshafts, respectively.

9. A V-type internal combustion engine as claimed in claim 7, wherein said control valve has a first state in which discharge of hydraulic fluid from said plurality of hydraulically actuable valve operation mode control actuators is allowed, and supply of hydraulic fluid to said plurality of hydraulically actuable valve operation mode control actuators is prohibited, and a second state in which discharge of hydraulic fluid from said plurality of hydraulically actuable valve operation mode control actuators is prohibited, and supply of hydraulic fluid to said plurality of hydraulically actuable valve operation mode control actuators is allowed.

10. A V-type internal combustion engine as claimed in claim 9, wherein each of said plurality of hydraulically actuable valve operation mode control actuators is in the form of a cam pulley, said can pulley including a cam sprocket, a camshaft sleeve fixedly coupled with the corresponding one of said two intake camshafts and disposed in said cam sprocket to define therebetween an annular bore, an annular piston disposed in said annular bore to provide drive connection between said cam sprocket and said camshaft sleeve, means for causing an angular displacement of said camshaft sleeve relative to said cam sprocket in response to an axial displacement of said annular piston, and hydraulic means for urging said annular piston to effect said axial displacement upon a shift of said control valve from said first state thereof to said second state thereof.

11. A V-type internal combustion as claimed in claim 8, wherein said control valve has a first state in which discharge of hydraulic fluid from said first pair of hydraulically actuable valve operation mode control actuators coupled with said two intake camshafts and discharge of hydraulic fluid from said second pair of hydraulically actuable valve operation mode control actuators coupled with said two exhaust camshafts are allowed, while supply of hydraulic fluid to said first pair of hydraulically actuable valve operation mode control actuators and supply of hydraulic fluid to said second pair of hydraulically actuable valve operation mode control actuators are prohibited;

a second state in which discharge of hydraulic fluid from said first pair of hydraulically actuable valve operation mode control actuators is prohibited and supply of hydraulic fluid to said first pair of hydraulically actuable valve operation mode control actuators is allowed, while discharge of hydraulic fluid from said second pair of hydraulically actuable valve operation mode control actuators is allowed and supply of hydraulically actuable valve operation mode control actuators is prohibited; and a third state in which discharge of hydraulic fluid from said first pair of hydraulically actuable valve operation mode control actuators is allowed and supply of hydraulic fluid to said first pair of hydraulically actuable valve operation mode control actuators is prohibited, while discharge of hydraulic fluid from said second pair of hydraulically actuable valve operation mode control actuators is prohibited and supply of hydraulic fluid to said second pair of hydraulically actuable valve operation mode control actuators is allowed.

12. A V-type internal combustion engine as claimed in claim 11, wherein each of said plurality of hydraulically actuable valve operation mode control actuators is in the form of a cam pulley, said cam pulley including a cam sprocket, a camshaft sleeve fixedly coupled with the corresponding one of said two intake camshafts and disposed in said cam sprocket to define therebetween an annular bore, an annular piston disposed in said annular bore to provide drive connection between said cam sprocket and said camshaft sleeve, means for causing an angular displacement of said camshaft sleeve relative to said cam sprocket in response to an axial displacement of said annular piston, and hydraulic means for urging said annular piston to effect said axial displacement upon a shift of said control valve from said first state thereof to one of said second and third states thereof.

13. A V-type internal combustion engine as claimed in claim 2, wherein said first and second cylinder banks include a cylinder block formed with a main gallery, and wherein said source of pressurized fluid includes said main gallery.

14. A V-type internal combustion engine as claimed in claim 13, wherein said hydraulic fluid network includes a pipe having one end communicating with said main gallery and an opposite end connected to said integral boss of said casing.

15. A V-type internal combustion engine as claimed in claim 14, wherein said pipe extends through a space disposed between said first and second cylinder banks.

16. A V-type internal combustion engine as claimed in claim 5, wherein said casing has an integral boss formed with a bore receiving therein said control valve.

17. A V-type internal combustion engine as claimed in claim 16, wherein said first and second cylinder banks include a cylinder block formed with a main gallery, and wherein said source of pressurized fluid includes said main gallery.

18. A V-type internal combustion engine as claimed in claim 17, wherein said hydraulic fluid network includes a pipe having one end communicating with said main gallery and an opposite end connected to said integral boss of said casing.

19. A V-type internal combustion engine as claimed in claim 18, wherein said pipe extends through a space disposed between said first and second cylinder banks.

20. A V-type internal combustion engine as claimed in claim 19, wherein said cooling means includes said pipe.

21. A V-type internal combustion engine as claimed in claim 13, wherein said first cylinder bank includes a cylinder head formed with a passage having one end communicating with said main gallary of said cylinder block and an opposite end, and wherein said casing includes a supply passage having one end communicating with said opposite end of said passage of said cylinder head and an opposite end connected to said integral boss.

22. A V-type internal combustion engine as claimed in claim 21, wherein said hydraulic fluid network includes said passage of said cylinder head and said supply passage of said casing.

23. A V-type internal combustion engine as claimed in claim 13, wherein said hydraulic fluid network includes a sub-block fixed to said cylinder block and said boss of said casing, said sub-block being formed with a passage having one end communicating with said main gallery and an opposite end and a sub-gallery connected to said opposite end of said passage and to said boss of said casing.

* * * * *